US010762887B1

(12) United States Patent
Tang et al.

(10) Patent No.: US 10,762,887 B1
(45) Date of Patent: Sep. 1, 2020

(54) SMART VOICE ENHANCEMENT ARCHITECTURE FOR TEMPO TRACKING AMONG MUSIC, SPEECH, AND NOISE

(71) Applicant: Dialpad, Inc., San Francisco, CA (US)

(72) Inventors: Qian-Yu Tang, Milpitas, CA (US); John Rector, Oakland, CA (US)

(73) Assignee: Dialpad, Inc., San Francisco, CA (US)

( * ) Notice: Subject to any disclaimer, the term of this patent is extended or adjusted under 35 U.S.C. 154(b) by 0 days.

(21) Appl. No.: 16/521,205

(22) Filed: Jul. 24, 2019

(51) Int. Cl.
*G10H 7/00* (2006.01)
*G10H 7/10* (2006.01)

(52) U.S. Cl.
CPC ..... *G10H 7/008* (2013.01); *G10H 7/105* (2013.01); *G10H 2210/021* (2013.01); *G10H 2210/046* (2013.01); *G10H 2210/051* (2013.01)

(58) Field of Classification Search
CPC ..... G10H 2210/076; G10H 1/40; G10H 2250/235; G10H 2210/031; G10H 2240/311; G10H 2210/375; G10H 2250/031; G10H 2220/086; G10H 1/0066
See application file for complete search history.

(56) References Cited

U.S. PATENT DOCUMENTS 8,952,233 B1 * 2/2015 Johnson ..... G10H 1/40 84/652
2012/0158401 A1 6/2012 Mazurenko et al.
2013/0339035 A1 * 12/2013 Chordia ..... G10L 19/00 704/500
2014/0180673 A1 * 6/2014 Neuhauser ..... G10H 1/40 704/9
2014/0180674 A1 * 6/2014 Neuhauser ..... G10H 1/0008 704/9
2014/0229831 A1 * 8/2014 Chordia ..... G06F 3/0482 715/717
2014/0358265 A1 * 12/2014 Wang ..... G10H 1/40 700/94
2015/0094835 A1 * 4/2015 Eronen ..... G06F 3/165 700/94
2015/0120308 A1 * 4/2015 Leistikow ..... G10H 1/366 704/500
2016/0210947 A1 * 7/2016 Rutledge ..... G10H 1/0008
2016/0210951 A1 * 7/2016 Rutledge ..... G10H 1/38

OTHER PUBLICATIONS

"Series P: Telephone Transmission Quality, Telephone Installations, Local Line Networks", Telecommunication Standardization Sector of ITU, P.862, Feb. 2001, 30 pgs.

(Continued)

*Primary Examiner* — Marlon T Fletcher
(74) *Attorney, Agent, or Firm* — Patent Law Works, LLP

(57) ABSTRACT

Audio data describing an audio signal may be received and used to determine a set of frames of the audio signal. A plurality of note onsets in the set of frames may be identified based on spectral energy of the audio signal in the set of frames. One or more tempos may be computed based on the identified plurality of note onsets. The one or more tempos may be validated based on a tempo validation condition. One or more music states of the audio signal may be determined based on the validated one or more tempos. Audio enhancement of the audio signal may be modified based on the one or more determined states of the audio signal.

25 Claims, 15 Drawing Sheets

(56) References Cited

OTHER PUBLICATIONS

Bello, Juan Pablo et al., "A Tutorial on Onset Detection in Music Signals", IEEE Transactions on Speech and Audio Processing, Aug. 6, 2003, 13 pgs.
"Series G: Transmission Systems and Media, Digital Systems and Networks, International telephone connections and circuits—General definitions", Telecommunication Standardization Sector of ITU, G.107, Mar. 2005, 28 pgs.
Grosche, Peter et al., "Extracting Predominant Local Pulse Information From Music Recordings", IEEE Transactions on Audio, Speech, and Language Processing, Aug. 2011, 14 pgs.
Muller, Meinard, "Fundamentals of Music Processing", © Springer International Publishing Switzerland 2015, Chapter 6, pp. 303-346.

* cited by examiner

901

903 905 907 909

| Index $i$ | $CB_L(i)$ | $CB_H(i)$ | HFC weight |
|---|---|---|---|
| 0 | 0 | 3 | 0 |
| 1 | 4 | 6 | 0 |
| 2 | 7 | 10 | 0 |
| 3 | 11 | 13 | 0 |
| 4 | 14 | 16 | 0 |
| 5 | 17 | 20 | 0 |
| 6 | 21 | 25 | 0 |
| 7 | 26 | 29 | 0 |
| 8 | 30 | 35 | 0 |
| 9 | 36 | 41 | 1 |
| 10 | 42 | 47 | 1 |
| 11 | 48 | 55 | 1 |
| 12 | 56 | 64 | 1 |
| 13 | 65 | 74 | 2 |
| 14 | 75 | 86 | 2 |
| 15 | 87 | 100 | 4 |
| 16 | 101 | 118 | 4 |
| 17 | 119 | 128 | 4 |

Figure 9

1001

| Metric (dB in Q5) | Onset score | Music factor |
|---|---|---|
| [0, 1000) | 0 | 0 |
| [1000, 2000) | 1 | 1 |
| [2000, 3000) | 2 | 2 |
| [3000, 5000) | 3 | 3 |
| [5000, 7000) | 5 | 5 |
| [7000, 10000) | 9 | 7 |
| [10000, 20000) | 16 | 10 |
| above 20000 | 18 | 10 |

Figure 10

SMART VOICE ENHANCEMENT ARCHITECTURE FOR TEMPO TRACKING AMONG MUSIC, SPEECH, AND NOISE

TECHNICAL FIELD

This disclosure pertains generally to computerized telephony and audio enhancement technology, and more specifically to automatic tempo tracking among music, speech, and noise in communication systems.

BACKGROUND

Music is becoming increasingly popular in telephony applications, such as music on hold, tele-conferencing, and video communications using smart phones, etc., particularly, as sampling rates increase. For instance, with increasing bandwidth and sampling rate in telephony applications, from the original narrow-band 8000 Hz, to wide-band 16000 Hz, and even to full-band 48000 Hz, high fidelity music is practicable. As a result, there is a trend to use more music in telephony applications.

Audio enhancement may be performed in telephony applications to improve voice quality by removing impairments such as noise and echo from an audio signal; however audio enhancement to voice or other sounds may negatively affect music. Accordingly, previous technologies fail to address the constraints presented by encountering music of varying genres among speech, noise, or tones, which may share the same bandwidth of frequencies with the music.

SUMMARY

Audio data describing an audio signal may be received and a set of frames of the audio signal may be determined using the audio data. The set of frames of the audio signal may be determined by performing a Fast Fourier Transform using a windowing function.

A plurality of note onsets in the set of frames may be identified based on spectral energy of the audio signal in the set of frames. The system may validate at least one of the identified plurality of note onsets based on a signal spectral energy of one or more of the set of frames. The system may validate the identified plurality of note onsets by determining a quantity of the set of frames between a first frame of a particular state of the one or more music states and a frame in which a particular note onset is detected, determining that the quantity of the set of frames between the first frame and the frame of the particular note onset satisfies a defined threshold and, responsive to determining that the quantity of frames satisfies the defined threshold, setting the one or more music states to an initial state, the initial state indicating that music has not been detected in the audio signal.

One or more tempos may be computed based on the identified plurality of note onsets, and the one or more tempos may be validated based on a tempo validation condition. Validating the one or more tempos may include computing a quantity of the identified plurality of note onsets during a period of a valid tempo of the one or more tempos, determining that the quantity of the identified plurality of note onsets satisfies a defined threshold and, responsive to determining that the quantity of the identified plurality of note onsets satisfies the defined threshold, setting the one or more music states to an initial state, the initial state indicating that music has not been detected in the audio signal.

In some implementations, the tempo validation condition comprises a tempo swing condition. The system may validate the one or more tempos based on the tempo swing condition by performing operations including determining a tempo swing condition threshold based on an initial tempo of the one or more tempos and a defined multiplier, determining a maximum tempo of the one or more tempos, determining a minimum tempo of the one or more tempos, and determining a difference between the maximum tempo and the minimum tempo, determining that the difference satisfies the tempo swing condition threshold. Responsive to determining that the difference satisfies the tempo swing condition threshold, the system may set the one or more music states to an initial state, which indicates that music has not been detected in the audio signal.

In some instances, operations for validating the one or more tempos based a tempo validation condition may include determining that a second tempo differs from a first tempo by a threshold amount; and, responsive to determining that the second tempo differs from the first tempo by greater than the threshold amount: searching for an additional note onset, determining a tempo for the additional note onset, and determining whether the tempo for the additional note onset satisfies a tempo swing condition, the tempo swing condition indicating whether a range of the first tempo and the second tempo satisfy a determined tempo swing condition threshold.

One or more music states of the audio signal may be determined based on the validated one or more tempos. For example, the system may determine one or more states of a finite state machine based on the validated one or more tempos and declare that the audio signal includes music based on a transition of the one or more states to a final state of the finite state machine, where the one or more music states include the final state.

In some implementations, a music state may be determined by performing operations including determining that a plurality of the one or more tempos satisfy a tempo swing condition, the tempo swing condition indicating whether a range of the plurality of the one or more tempos satisfy a determined tempo swing condition threshold, and transitioning a finite state machine from a first of the one or more music states to a second of the one or more music states based on the determination that the plurality of the one or more tempos satisfy the tempo swing condition.

In some implementations, operations for determining the one or more music states may include detecting that a state duration of a particular music state of the one or more music states has elapsed, transitioning a finite state machine from the particular music state to a legato tempo detection state, detecting a note onset while in the legato tempo detection state, computing a potential legato tempo based on the detected note onset, and validating the potential legato tempo based on a multiple of an initial tempo of the one or more tempos.

In some implementations, operations for determining the one or more music states may include computing an average quantity of the set of frames between note onsets in the identified plurality of note onsets, determining whether the average quantity of the set of frames between the note onsets satisfies a threshold length and, responsive to determining that the average quantity does not satisfy the threshold length, setting the one or more music states to an initial state, the initial state indicating that music has not been detected in the audio signal.

In some implementations, operations for determining the one or more music states may include determining whether a total onset score satisfies a first threshold, an onset score of the total onset score representing a signal energy of a note onset of the plurality of note onsets, determining whether a total music factor score satisfies a second threshold, where a music factor score representing a high-frequency component of the note onset of the plurality of note onsets. The operations may include transitioning a finite state machine to a final state based on the total onset score satisfying the first threshold and the total music factor score satisfying the second threshold, the one or more music states including the final state, and declaring that the audio signal includes music based on the final state.

Audio enhancement of the audio signal may be modified based on the one or more music states. For instance, modifying the audio enhancement of the audio signal may include ceasing noise cancelation of the audio signal.

The features and advantages described in this summary and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 9 illustrates a table of an example critical band distribution.

FIG. 10 illustrates a table with example metric scores, onset scores, and music factors.

Figure 1:
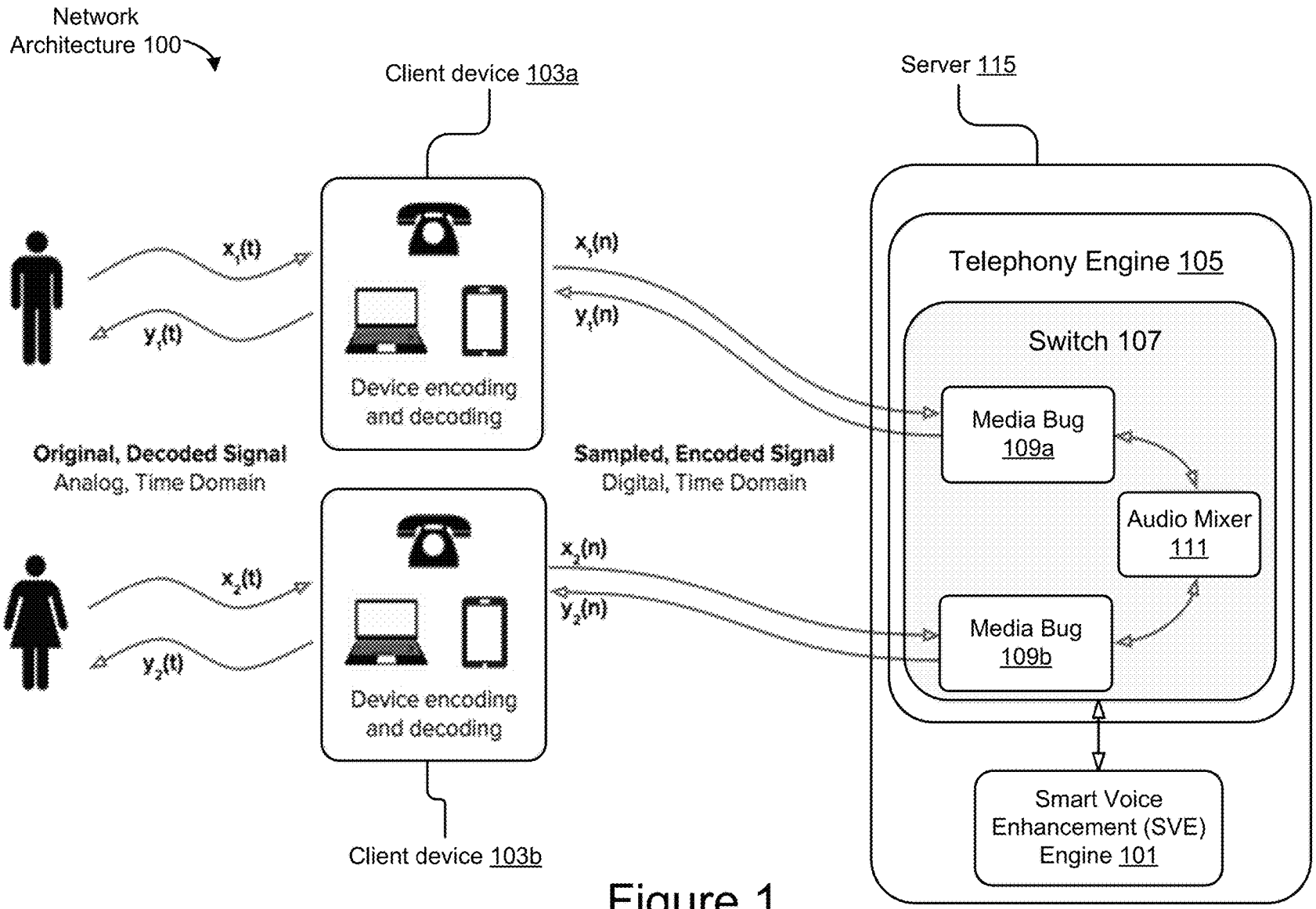
FIG. 1 is a block diagram of an exemplary network architecture in which audio signals may be analyzed.

The Figures depict various example implementations for purposes of illustration only. One skilled in the art will readily recognize from the following discussion that alternative examples of the structures and methods illustrated herein may be employed without departing from the principles described herein.

DETAILED DESCRIPTION

The technology described herein monitors the content and/or sound characteristics of audio signals, automatically detects music, and, in some instances, may adjust audio enhancement based on the detection of music.

For instance, the disclosure describes a system and method for tempo tracking in a communication system, which allows the system to modify audio enhancement for the music from the other parts of audio signal. Smart voice enhancement may improve voice quality by removing impairments such as noise and echo in telephony applications. In some implementations, the technology may detect music in real-time and bypass performing certain audio enhancement (e.g., reducing noise and echo) on it in order to deliver music to end users, because, for example, noise cancellation may distort music. It should be noted that although the term smart "voice" enhancement is used herein, the technology may be used to process and/or enhance any type of audio.

The technology described herein detects music in real-time as soon as possible among music, speech, and noise whenever music packets show up in telephony applications. For instance, to avoid an unpleasant experience for an end user, music detection time should be as short (e.g., half a second to two seconds) as possible for telephony applications, and detection accuracy should be very high. However, music detection in real-time by a computing device (e.g., on a client or server side) is difficult, in part, because music, speech, noise, and noisy speech share a common frequency bandwidth. Additionally, there are many different kinds of music and assumptions that a particular kind of music will be encountered may lead to decreased performance for other music types in audio streams. For example, music genres span an enormous range of forms and styles, from popular, rock, and jazz music, to symphonies with a full orchestra. Further, musical instruments may include, among others, percussion (e.g., piano, drum, bell, etc.,), string (violin, viola, cello, guitar, etc.), woodwind (flute, clarinet, etc.), or brass (trombone, tuba, trumpet, etc.).

While previous technologies focused on heuristics for detecting specific songs, specific instruments, or specific genres of music, the technology described herein works across a variety of types of music, for example, by looking at the underlying tempo in the received audio. The technology may perform music detection in real-time solely or partially based on processing incoming audio, which allows it to, for example, remove noise during speech without degrading music quality.

In some implementations, the technology described herein may base a detection of music on a transition of one or more tempo tracking states to a final state in a finite state machine. In some implementations, the technology may perform additional operations that improve the efficiency and/or accuracy of music detection, as described in further detail below.

With reference to the figures, reference numbers may be used to refer to components found in any of the figures, regardless whether those reference numbers are shown in the figure being described. Further, where a reference number includes a letter referring to one of multiple similar components (e.g., component 000a, 000b, and 000n), the reference number may be used without the letter to refer to one or all of the similar components.

FIG. 1 is a block diagram of an exemplary network architecture 100 in which audio signals may be analyzed. The network architecture 100 may represent a telephony engine data path in which a smart voice enhancement engine 101 may be implemented. The illustrated network architecture may include one or more servers 115 and one or more endpoint client devices 103, which may be communicatively coupled via a network (not illustrated). In some implementations, the client devices 103*a* and 103*b* may be coupled via a network and may communicate via and/or receive services provided by the telephony engine 105 and/or a smart voice enhancement engine 101. It is to be understood that, in practice, orders of magnitude more endpoints (e.g., 103) and servers (e.g., 115) can be deployed.

A smart voice enhancement engine 101 is illustrated as residing on a server 115. It is to be understood that, in different implementations, the smart voice enhancement engine 101 can reside on different servers 115 or client devices 103, or be distributed between multiple computing systems in different ways, without departing from the scope of this disclosure.

Many different networking technologies can be used to provide connectivity from endpoint computer systems 103 to servers 115. Some examples include: LAN, WAN, and various wireless technologies. Endpoint systems 103 are able to access applications and/or data on server 115 using, for example, a web browser or other endpoint software (not shown). Endpoint client devices 103 can be in the form of, for example, desktop computers, laptop computers, smartphones, analog phones, or other communication devices capable of sending and/or receiving audio. Servers 115 can be in the form of, for example, rack mounted or tower computers or virtual servers implemented as software on a computing device, depending on the implementation.

Although FIG. 1 illustrates two endpoints 103 and one server 115 as an example, but in practice many more (or fewer) devices can be deployed as noted above. In some implementations, the network is in the form of the internet, public switched telephone network (PSTN), or different communication system. Other networks or network-based environments can be used in addition to or instead of the internet in other implementations.

As illustrated in FIG. 1, a user may communicate via a client device 103*a* using speech or other audio, which may be received by the client device 103*a* as analog time-domain audio. In some implementations, the client device 103*a* may transmit the audio to the server 115 in a digital time-domain audio signal, although other implementations are possible. For instance, the telephony engine 105 may receive the audio signal from the client device 103*a* and, using a switch 107, may relay the audio to a second client device 103*b*, which may convert the audio signal to audio using an output device. It should be noted that the telephony engine 105 may enable two way communication between the client devices 103.

The telephony engine 105 may include a switch 107 and, in some implementations, a smart voice enhancement engine 101. In some implementations, the switch 107 may include an application server that enables real-time communication of audio and/or video using telecommunications and/or Voice over Internet Protocol (VoIP), for example. The switch 107 may run one or more media bugs 109*a* and 109*b*, an audio mixer 111, and, in some instances, a smart voice enhancement engine 101 or components thereof.

Figure 3A:
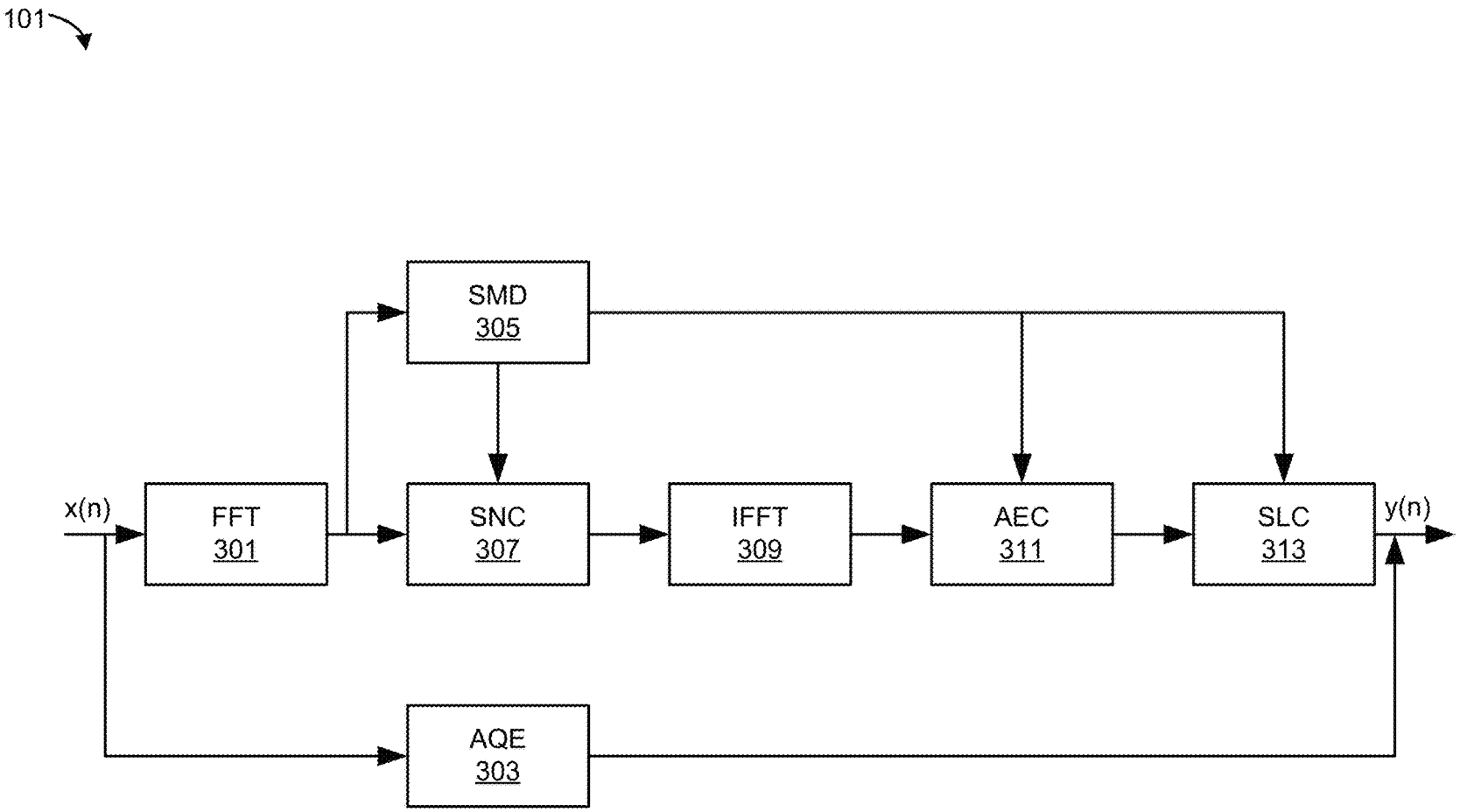
FIG. 3A is a block diagram of a smart voice enhancement engine.

In some implementations, a media bug 109 may include a dynamic library that provides an interface between one or more of the client devices 103, the smart voice enhancement engine 101, the audio mixer 111, the switch 107, and one or more other components of the telephony engine 105, such as a management interface (not shown). The audio mixer 111 may adjust volume levels, tones, or other elements of an audio signal, or perform other operations, depending on the implementation. The management interface may provide configuration and parameter setup for the modules smart voice enhancement engine 101, such as are shown in FIG. 3A.

In some implementations, the smart voice enhancement engine 101 may include a library implemented on top of the switch 107 platform, but independent of the switch 107 as a stand-alone library. The smart voice enhancement engine 101 may operate on the server 115, although it is possible for it to operate on one or more of the client devices 103 without departing from the scope of this disclosure. The smart voice enhancement engine 101 may improve voice quality in a communication system by removing impairments such as noise and echo in telephony applications. For instance, as described in further detail in reference to FIGS. 4-10, the smart voice enhancement engine 101 may detect music and bypass it in order to deliver unmodified music (or music modified differently than speech, etc.) to end users to avoid degradation of the music, which may be caused by voice enhancement processing, such as noise cancellation.

One or more of the components of the telephony engine 105 (e.g., the switch 107, media bug 109, audio mixer 111, or smart voice enhancement engine 101) may include software including logic executable by a processor to perform their respective acts, although the component may be implemented in hardware (e.g., one or more application specific integrated circuits (ASICs) coupled to a bus for cooperation and communication with the other components of the telephony engine 105 and/or network architecture 100; sets of instructions stored in one or more discrete memory devices (e.g., a PROM, FPROM, ROM) that are coupled to a bus for cooperation and communication with the other components of the system; a combination thereof; etc.).

Figure 2:
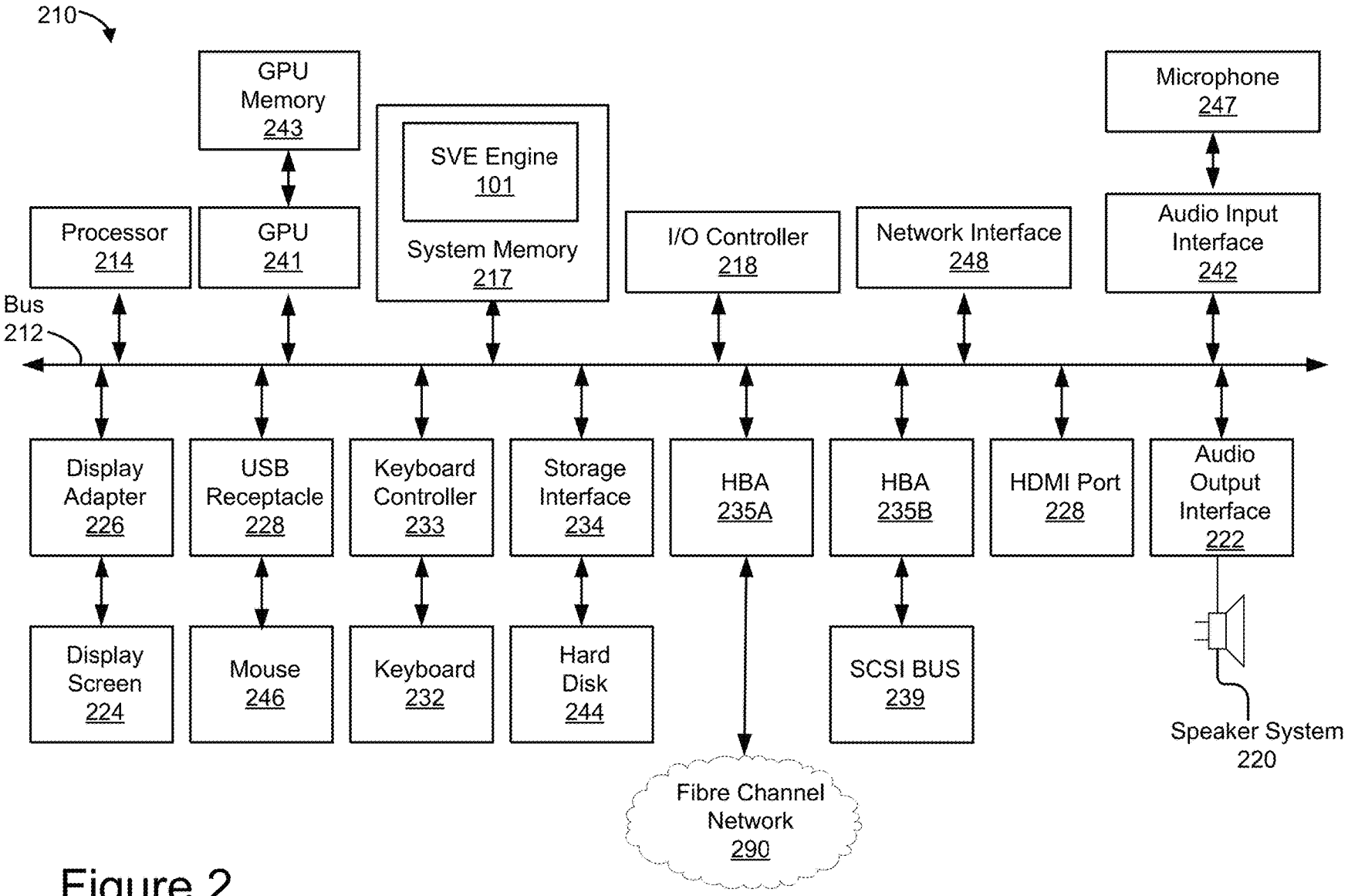
FIG. 2 is a block diagram of a computer system suitable for implementing a smart voice enhancement and music detection system.

FIG. 2 is a block diagram of a computer system 210 suitable for implementing a smart sound enhancement and music detection system. For instance, the computer system 210 may represent a server 115, which may execute the operations of the smart voice enhancement engine 101. Endpoints 103 and servers 115 can be implemented in the form of such computer systems 210. As illustrated, one component of the computer system 210 is a bus 212. The bus 212 communicatively couples other components of the computer system 210, such as at least one processor 214, system memory 217 (e.g., random access memory (RAM), read-only memory (ROM), flash memory), a graphics processing unit (GPU) 241, GPU memory 243, an input/output (I/O) controller 218, an audio input interface 242 communicatively coupled to an audio input device such as a microphone 247, an audio output interface 222 communicatively coupled to an audio output device such as a speaker 220, a display adapter 226 communicatively coupled to a video output device such as a display screen 224, one or more interfaces such as Universal Serial Bus (USB) ports 228, High-Definition Multimedia Interface (HDMI) ports 230, serial ports (not illustrated), etc., a keyboard controller 233 communicatively coupled to a keyboard 232, a storage interface 234 communicatively coupled to one or more hard disk(s) 244 (or other form(s) of storage media), a host bus adapter (HBA) interface card 235A configured to connect with a Fiber Channel (FC) or other network 290, an HBA interface card 235B configured to connect to a SCSI bus 239, a mouse 246 (or other pointing device) coupled to the bus 212, e.g., via a USB port 228, and one or more wired and/or wireless network interface(s) 248 coupled, e.g., directly to bus 212.

Other components (not illustrated) may be connected in a similar manner (e.g., document scanners, digital cameras, printers, etc.). Conversely, all of the components illustrated in FIG. 2 need not be present (e.g., smartphones, tablets, and some servers typically do not have external keyboards 242 or external pointing devices 246, although various external components can be coupled to mobile computing devices via, e.g., USB ports 228). In different implementations the various components can be interconnected in different ways from that shown in FIG. 2.

The bus 212 allows data communication between the processor 214 and system memory 217, which, as noted above may include ROM and/or flash memory as well as RAM. The RAM is typically the main memory into which the operating system and application programs are loaded. The ROM and/or flash memory can contain, among other code, the Basic Input-Output system (BIOS) which controls certain basic hardware operations. Application programs can be stored on a local computer readable medium (e.g., hard disk 244, solid state drive, flash memory) and loaded into system memory 217 and executed by the processor 214. Application programs can also be loaded into system memory 217 from a remote location (i.e., a remotely located computer system 210), for example via the network interface 248. In FIG. 2, the smart voice enhancement engine 101 is illustrated as residing in system memory 217. The operations and features of the smart voice enhancement engine 101 are explained in greater detail below in conjunction with FIGS. 3A-10.

The storage interface 234 is coupled to one or more hard disks 244 (and/or other standard storage media). The hard disk(s) 244 may be a part of computer system 210, or may be physically separate and accessed through other interface systems.

The network interface 248 can be directly or indirectly communicatively coupled to a network such as the Internet, a PSTN, etc. Such coupling can be wired or wireless.

FIG. 3A illustrates an example smart voice enhancement engine 101. As described above, the functionalities of the smart voice enhancement engine 101 can reside on specific computers 210 (endpoints 103, servers 105) or be otherwise distributed between multiple computer systems 210, including within a cloud-based computing environment in which the functionality of the smart voice enhancement engine 101 is provided as a service over a network. It is to be understood that although the smart voice enhancement engine 101 is illustrated in FIG. 2 as single entity, the illustrated smart voice enhancement engine 101 represents a collection of functionalities, which can be instantiated as a single or multiple modules as desired (an instantiation of an example multiple module smart voice enhancement engine 101 is illustrated in FIG. 3). It is to be understood that the modules of the smart voice enhancement engine 101 can be instantiated (for example as object code or executable images) within the system memory 217 (e.g., RAM, ROM, flash memory) (and/or the GPU memory 243) of any computer system 210, such that when the processor(s) 214 (and/or the GPU 241) of the computer system 210 processes a module, the computer system 210 executes the associated functionality. In some implementations, the GPU 241 can be utilized for some or all of the processing of given modules of the smart voice enhancement engine 101. In different implementations, the functionality of some or all of the modules of the smart voice enhancement engine 101 can utilize the CPU(s) 214, the GPU 241, or any combination thereof, as well as system memory 217, GPU memory 243, or any combination thereof as desired.

As used herein, the terms "computer system," "computer," "endpoint," "endpoint computer," "server," "server computer" and "computing device" mean one or more computers configured and/or programmed to execute the described functionality. Additionally, program code to implement the functionalities of the smart voice enhancement engine 101 can be stored on computer-readable storage media. Any form of tangible computer readable storage medium can be used in this context, such as magnetic, optical or solid state storage media. As used herein, the term "computer readable storage medium" does not mean an electrical signal separate from an underlying physical medium.

The smart voice enhancement engine 101 may use speech signal processing algorithms to enhance voice quality for VoIP, wireless, and PSTN telephony applications. As shown in the example illustrated in FIG. 3A, the smart voice enhancement engine 101 may include a Fast Fourier Transform (FFT) module 301, smart noise cancellation (SNC) module 307, inverse Fast Fourier Transform (IFFT) module 309, acoustic echo cancellation (AEC) module 311, smart level control (SLC) module 313, audio quality evaluation (AQE) module 303, and/or a smart music detection (SMD) module 305. In some implementations, although not illustrated in FIG. 3, the smart voice enhancement engine 101 may include functionality instantiating a voice activity detection algorithm (not shown), which may be incorporated or communicatively coupled with the smart music detection module 305.

Depending on the implementation, the FFT module 301 may convert an original time domain signal $\{x(n)\}$ to frequency domain signal $\{X(k)\}$. A voice activity detection algorithm may operate in the frequency domain, which employs the fact that the frequency spectral for noise tends to be flat. Similar to voice activity detection algorithm, the smart music detection module 305 may operate in the frequency domain. The other modules (e.g., 307, 309, 311, or 313) may use the output of the smart music detection module to identify music, speech, or noise.

The SNC module 307 may remove ambient noise in frequency domain, so that the listener feels more comfortable when listening to the speech with the noise removed. The IFFT module 309 may convert the frequency domain signal back to time domain by using the Inverse Fast Fourier Transform. The AEC 311 and SLC 313 may operate in the time domain to cancel acoustic eco and control audio volume levels, respectively. The output audio signal after smart voice enhancement processing is illustrated as $\{y(n)\}$.

The AQE module 303 may use objective voice quality measurement algorithms to monitor smart voice enhancement for the audio signals before and after smart voice enhancement. In some implementations, the AQE module 303 may use ITU (International Telecommunications Union) standards for quality assessment, such as a G.107 E-model and/or a Perceptual Evaluation of Speech Quality (PESQ) test(s) to monitor quality of the audio signal. For example, the AQE module 303 may compare speech output in the outgoing audio signal with original clean audio in the incoming audio signal in order to get a mean opinion score (MOS). In some implementations, the G.107 E-model in the AQE module 303 may provide real-time and non-intrusive voice quality measurement, for example, in terms of the MOS value for each call. The MOS may represent a score of ratings gathered in a quality evaluation test, which may be manually or algorithmically performed.

The smart music detection module 305 may perform some or all of the operations described in reference to FIGS. 4-10 for detecting music events. For instance, the smart music detection module 305 may detect note onsets, determine one or more tempos based on the note onsets, and validate the note onsets, tempos, and music, as described in further detail in reference to FIGS. 4-10.

The smart music detection module 305 may include a finite state machine to further increase the music detection accuracy in the context of music, speech, and noise. One or more potential music events may be combined to form a music state of the finite state machine. In some implementations, detection of noise may reset a music state of the finite state machine. With increasing valid tempo events the finite state machine may move from state to state until a final state is reached, based upon which, the smart music detection module 305 may declare that music is present in an audio signal.

It should be noted that the smart music detection module 305 may include sub-components, algorithms, or routines, for example, which may perform one or more of the operations described in reference to the smart music detection module 305.

In some implementations, the smart music detection module 305 may perform additional operations that improve the efficiency and/or accuracy of music detection. The smart music detection module 305 may determine a valid tempo in a state based on verification conditions, such as a tempo swing condition, which may check that a distance between a maximum and a minimum tempo is smaller than a defined threshold. In some instances, the smart music detection module 305 may track tempos for dotted notes by finding valid tempos among sets of note onsets. The smart music detection module 305 may calculate a new legato tempo in a legato state where a note lasts multiple tempo lengths such that the new legato tempo satisfies a tempo swing condition.

In some implementations, the smart music detection module 305 may perform tempo back tracking to determine multiple valid tempos based on previous note onsets. If, during back tracking, the smart music detection module 305 determines that there are multiple valid tempos, the smart music detection module 305 may transit finite state machine across multiple states toward a music detection state, thereby accelerating music detection.

Figure 3B:
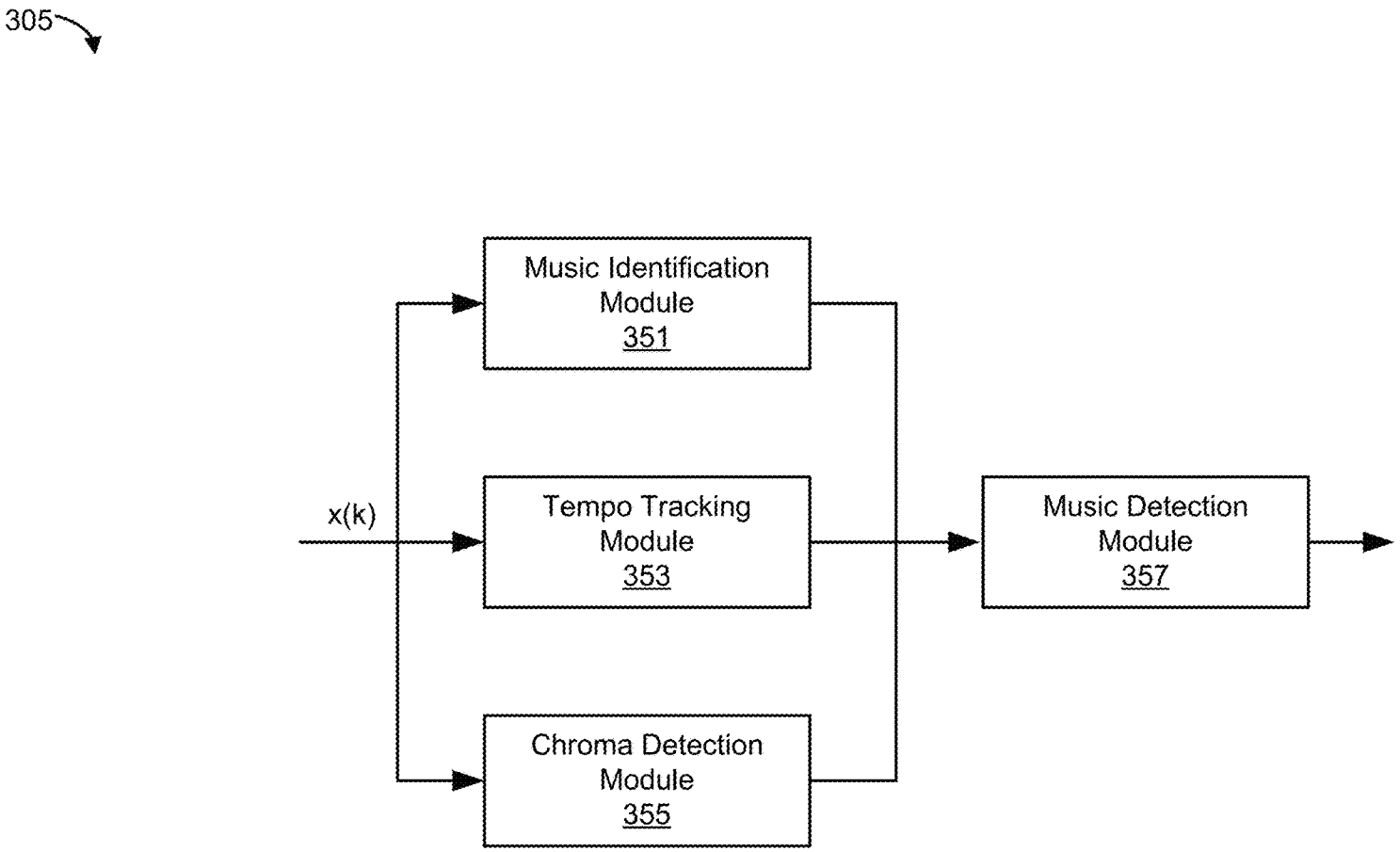
FIG. 3B illustrates an example architecture of a smart music detection module.

FIG. 3B illustrates an example architecture of a smart music detection module 305. In some implementations, the smart music detection module 305 may include multiple music detectors, such as a music identification module 351, a tempo tracking module 353, and a chroma detection module 355. Each music detector may use different technologies and serve different purposes in order to more accurately detect different kinds of music. The music detectors may operate in parallel to achieve efficient music detection for varying kinds of music in very short time (e.g., a half second, two seconds, etc.) in telephony applications. For example, the smart music detection module 305 may declare that the audio signal includes music if any of the music detectors declares that music is present.

In some implementations, the music identification module 351 may detect a wave profile of an incoming audio signal and may match the wave profile against a database of wave profiles, thereby detecting a specific song, etc.

In some implementations, the chroma detection module 355 may detect notes and determine whether the notes appear consistently in an audio signal, such as when chroma shows up consistently in the incoming audio packets. For instance, based on frequencies for equal-tempered scale, if two or more octaves among octaves 4-9 have the same chroma value with maximum energy, then the chroma consecutive detection counter is increased by one or, if the chroma values do not match, the counter may be reset to zero. If the chroma shows up consistently in a consecutive ten frames (e.g., such that the chroma consecutive detection counter satisfies a threshold), a music event may be declared. Since the peak note in each octave for speech and noise normally shows a random pattern, the false detection probability for such music event if speech or noise is present is as small as 10^(−10).

The tempo tracking module 353 may recognize various types of music, such as music that uses percussion. For instance, when a consistent tempo appears in an audio signal, the tempo tracking module 353 may detect the tempo and declare that music is present. For example, consistent tempo normally shows up in percussion music, such as music with piano, guitar, drum, bell, cymbal, gong, timpani, xylophone, etc. Example operations of the tempo tracking module 353 are described throughout this disclosure, for example, in reference to FIGS. 4-10.

The music detection module 357 may declare music based on detection of music by one or more of the music identification module 351, tempo tracking module 353, and chroma detection module 355. For instance, both chroma and tempo may exist at the same time, so when, at the earliest time when music is detected by any music detector, the smart music detection module 305 modify voice enhancement to deliver perfect music to the end users. For example, both chroma detection and tempo tracking methods may complement each other. In some music, chroma may be lacking, but tempo shows up consistently, for example, in certain genres of percussion music. For instance, the sound of different drums may shows a burst of energy, without sufficient chroma signatures, so tempo tracking may be the efficient detector in real time for these types of music.

Figure 4:
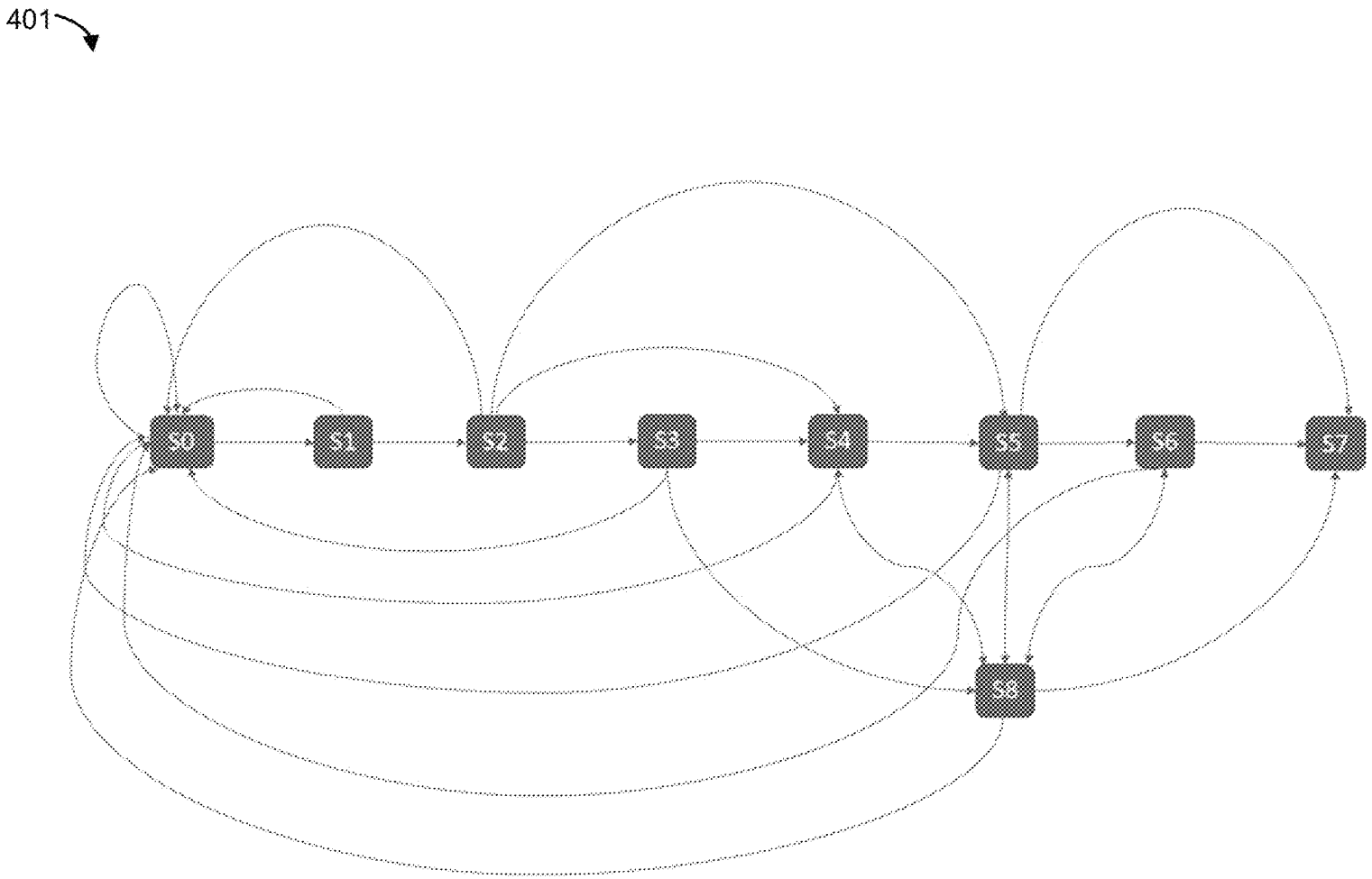
FIG. 4 is a diagram of a state transition of a finite state machine for tempo tracking.

FIG. 4 is a diagram 401 of a state transition of a finite state machine for tempo tracking. The smart music detection module 305 may detect music by identifying consistent tempo present in the audio packets among music, noise, and speech. The smart music detection module 305 may use a finite state machine (FSM) for tempo tracking. An example state diagram of the finite state machine is shown in FIG. 4. Additional details of the finite state machine and transitions between states are described in FIGS. 5-10.

The finite state machine starts from state $S_0$. A finite state machine generally consists of M states and the techniques described herein use M=9 for illustration. In C language, the states may be defined as follows: typedef enum {TT_STATE( )=0, TT_STATE1, TT_STATE2, TT_STATE3, TT_STATE4, TT_STATE5, TT_STATE6, TT_STATE7, TT_STATE8} tTT_STATE;

For the purposes of description herein, the finite state machine may have a data structure tFSM_STATE, which has an instance of tTT_STATE, called tt_state, and each state has a life time called state_duration.

The states and transitions thereof in FIG. 4 show an initial state $S_0$, a tempo detection state $S_1$, one or more tempo verification states $S_2$-$S_6$, a legato tempo detection state $S_8$, and a music detected state $S_7$. The smart music detection module 305 may transit between states of the finite state machine as described below. It should be noted that a quantity of states M may be increased or decreased. For instance, if the quantity of states is increased, the detection time becomes longer and the detection accuracy is increased.

Figure 5:
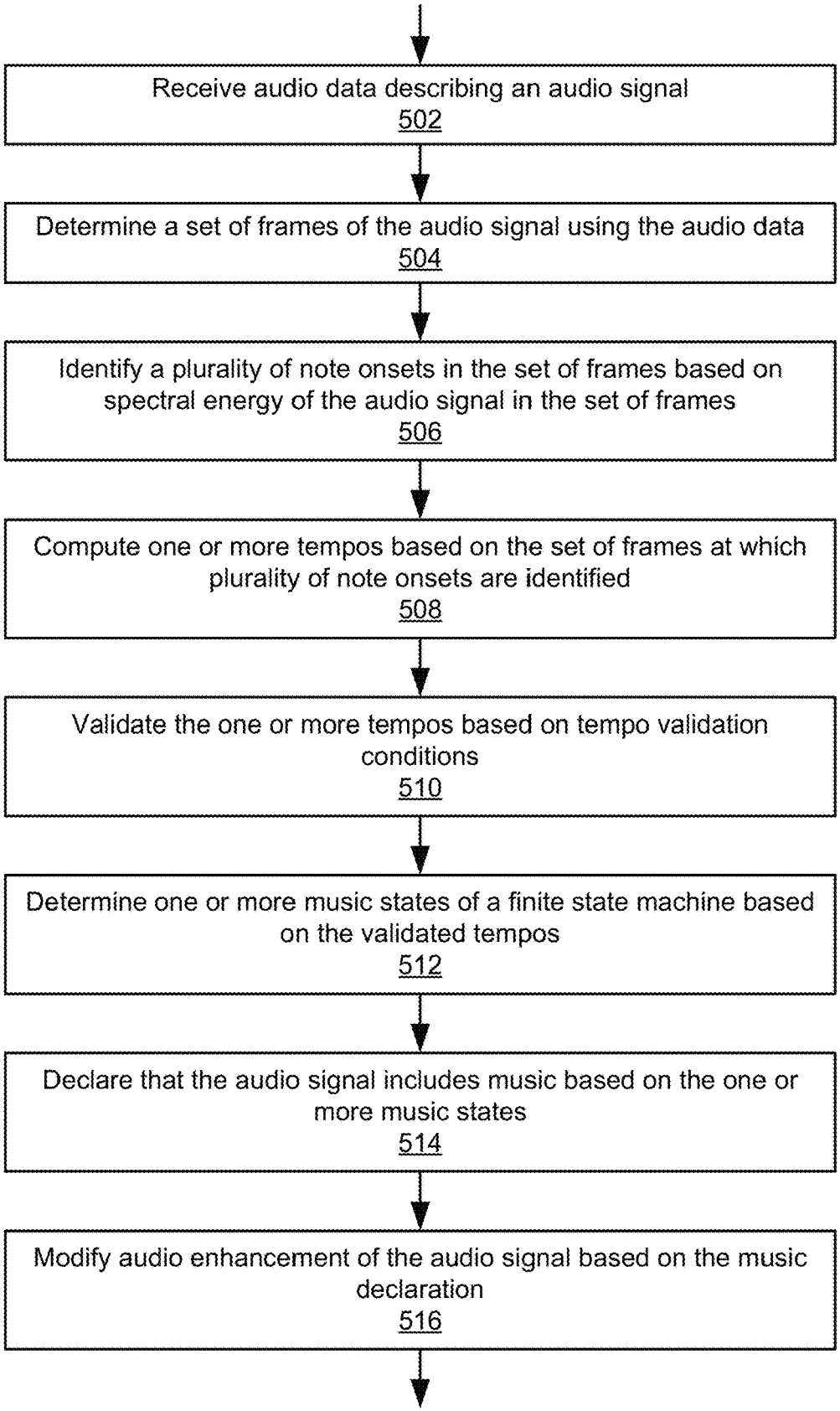
FIG. 5 is a flowchart of an example method for smart enhancement of an audio signal.

FIG. 5 is a flowchart of an example method for smart enhancement of an audio signal. In some implementations, at 502, the smart voice enhancement engine 101 may receive audio data describing an audio signal. For example, the smart music detection module 305 may receive an audio speech signal at a speech decoder, as illustrated in FIG. 1. The audio data may be in any audio format that may be processed by the smart voice enhancement engine 101. For example, the audio data may be a digital file representing a time-domain based signal.

At 504, the smart voice enhancement engine 101 may determine a set of frames of the audio signal using the audio data. For instance, the smart voice enhancement engine 101 (e.g., the FFT module 301) may perform Fast Fourier Transform framing with a windowing function.

For example, the discrete Fourier transform (DFT) of the time-domain signal {x(n)} is given as follows:

$$X(m,k)=\sum_{n=0}^{N-1}x(n+\mathrm{mH})w(n)e^{-j2\pi kn/N},\ 0\le k\le N-1, \tag{1}$$

where m is the frame number, k is the frequency bin, H is the frame hop size, N is the fast Fourier transform (FFT) size, and w(n) is the window function, n∈[0, N−1]. Example window functions that may be used may include rectangular, Bartlett, Hanning, Hamming, Blackman, and Kaiser windows, etc.

Similarly, it should be noted that, for use by the IFFT module 309 (or another component of the smart voice enhancement engine 101), the inverse DFT is given by $$x(n+\mathrm{mH})=\frac{1}{N}\sum_{k=0}^{N-1}X(m,k)e^{j2\pi kn/N},\ 0\le n\le N-1, \tag{2}$$

for the m-th frame.

In DFT formula (1), frequency bin k corresponds to the physical frequency $$F_{coef}(k)=k*\frac{F_s}{N},\ 0\le k\le N, \tag{3}$$

in Hz, where $F_s$ is the sampling frequency in Hz, and N is the FFT size.

In a public switched telephone network (PSTN), the sampling rate may be fixed at $F_s$=8000 Hz, resulting in maximum speech bandwidth 4000 Hz, based on sampling theorem, which corresponds to the narrow-band case. This sampling rate may also be used in voice-over-internet (VOIP) and wireless cellular networks, for example, when the following speech codecs are used: G. 711 (a-law and μ-law), G.729, G.723, G.726, AMR, GSM, GSM-HR, GSM-FR, etc. In some instances, a wide-band with sampling rate $F_s$=16000 Hz and an efficient signal bandwidth of 8000 Hz may be used. A wide band coder may include AMR-WB and G.722. Similarly, a full-band sampling rate $F_s$=48000 with efficient signal bandwidth up to 24000 Hz, including Opus codec, may be used.

In the narrow band case, N=256 points and the FFT has minimum granularity 8000/256=31.25 Hz based on (5) for the N bins, which may also be true for the wide band case with N=512. In the full band case, N=1024 points and the FFT has minimum granularity 48000/1024=46.875 Hz.

It should be noted that other implementations are possible, for clarity of description, this disclosure is described using the narrow band case, although wide band or full bands may also be used.

At 506, the smart voice enhancement engine 101 may identify a plurality of note onsets in the set of frames based on spectral energy of the audio signal in the set of frames. In some implementations, the smart voice enhancement engine 101 may validate at least one of the identified plurality of note onsets based on a signal spectral energy of one or more of the set of frames, for example, as described in FIG. 7.

The smart voice enhancement engine 101 may determine an onset based on a spectral analysis (e.g., using the signal spectral novelty functions described below) to determine an onset and onset score.

In some implementations, in order to discriminate a music event from speech or noise, the smart music detection module 305 may perform spectral analysis based on critical bands. In the voice spectrum, critical bands may be defined using the Bark scale: 100 Hz, 200 Hz, 300 Hz, 400 Hz, 510 Hz, 630 Hz, 770 Hz, 920 Hz, 1080 Hz, 1270 Hz, 1480 Hz, 1720 Hz, 2000 Hz, 2320 Hz, 2700 Hz, 3150 Hz, 3700 Hz, 4400 Hz, 5300 Hz, 6400 Hz, 7700 Hz, 9500 Hz, 12000 Hz, and 15500 Hz. In the case of narrow band, wide band, and full band, there may be eighteen, twenty-two, twenty-five critical bands, respectively.

The smart music detection module 305 may estimate the signal energy for the i-th critical band using $$E_{cb}(m,i)=\alpha E_{cb}(m-1,i)+(1-\alpha)\frac{1}{CB_H(i)-CB_L(i)+1}\sum_{k=CB_L(i)}^{CB_H(i)}|X(m,k)|^2, \tag{4}$$

where $0\le i<N_c$, α is a smoothing factor, $0\le\alpha<1$, $N_c$ is the number of total critical bands, and $CB_H(i)$ and $CB_L(i)$ are the highest and lowest FFT bins for the i-th critical band, respectively. Example choices for of α may include α=0.45, α=0.25, or α=0.1. $N_c$=18, 22, and 25 for the narrow (e.g., 256 points of granularity), wide (512 points), and full (1024 points) bands, respectively. In the narrow band, with a 256-point FFT, $CB_H(i)$ and $CB_L(i)$, $0\le i<N_c$ are provided in the table 901 in FIG. 9, for reference. FIG. 9 illustrates a table 901 of an example critical band distribution where the second column 905 and third column 907 represent the frequency bins, and the fourth column 909 is a weight for a high frequency component (HFC) that smart music detection module 305 may use to calculate a music factor (e.g., as described below and in reference to FIG. 10).

In some instances, the dB value of the signal spectral energy for the i-th critical band is defined by $$EdB_{cb}(m,i)=10\log_{10}E_{cb}(m,i),0\le i<N_c. \tag{5}$$

The total signal energy in dB based on critical bands may be given by $$EdB_{total}(m)=\sum_{i=0}^{N_c-1}EdB_{cb}(m,i), \tag{6}$$

for the m-th frame.

The half-wave rectification function may be defined as follows:

$$|x|_{\ge 0}=\begin{cases}x, & \text{if } x\ge 0\\ 0, & \text{otherwise}\end{cases} \tag{7}$$

To detect the onset of a note, a spectral novelty function may be defined. Depending on the implementation, the smart music detection module 305 may determine an onset score based on the calculations of the spectral novelty functions. In some instances, the smart music detection module 305 may determine onset scores of a set of frames and then determine a maximum onset score among the onset scores of the set of frames. The smart music detection module 305 may determine the note onset and an associated frame based on the maximum onset score. Further details for determining and validating the note onset and associated onset frame (denoted by fr_lock, for a determined note onset in a frame) are described in reference to FIG. 7.

The smart music detection module 305 may calculate the averaging temporal derivative of the signal spectral energy in logarithmic domain per critical band $$\mu(m,i)=\lambda\mu(m-1,i)+(1-\lambda)|EdB(m,i)-EdB(m-1,i)|_{\geq 0}, \tag{8}$$

where $0\leq i<N_c$, $\lambda$ is a smoothing factor, $0\leq\lambda<1$, EdB(m,i) is defined in (5), and $|x|_{\geq 0}$ is defined in (7). Typical $\lambda$ may include $\lambda=0.98$, $\lambda=0.9667$, and $\lambda=0.9$, for example.

The spectral novelty function may be defined as follows:

$$\Gamma 1(m)=\sum_{i=0}^{N_c-1}\|EdB(m,i)-EdB(m-1,i)|_{\geq 0}-\mu(m,i)|_{\geq 0}. \tag{9}$$

The spectral novelty function (9) is defined using power spectral density (PSD) per critical band, which is in comparison with that defined using the frequency bins. The averaging operation in (4)-(5) may obtain reliable onset detection results.

The spectral novelty functions (8)-(9) may be calculated using the first-order derivative or difference of the power spectral density per critical band in logarithmic domain. The smart music detection module 305 may also employ a second-order difference, which can be used to detect the note onset. For instance, the smart music detection module 305 may first calculate the averaging second-order difference of the signal spectral energy in logarithmic domain per critical band as follows $$\xi(m,i)=\lambda\xi(m-1,i)+(1-\lambda)|EdB(m,i)-EdB(m-2,i)|_{\geq 0}, \tag{10}$$

where $0\leq i<N_c$, $\lambda$ is a smoothing factor, $0\leq\lambda<1$. The spectral novelty function based on the second-order difference may be defined as follows:

$$\Gamma 2(m)=\sum_{i=0}^{N_c-1}\|EdB(m,i)-EdB(m-2,i)|_{\geq 0}-\xi(m,i)|_{\geq 0}. \tag{11}$$

In some implementations, the smart music detection module 305 may use a threshold onset score TT_MIN_SCORE (e.g., TT_MIN_SCORE=one) to verify whether a note onset is valid. Depending on the implementation, a threshold onset score may be used for states except state $S_0$. In order to discriminate noise and speech, at $S_0$ the smart music detection module 305 may use a different threshold TT_GATE_SCORE (e.g., TT_GATE_SCORE=two), to allow the smart music detection module 305 to detect note onsets of varying strengths.

At 508, the smart voice enhancement engine 101 may compute one or more tempos based on the set of frames at which plurality of note onsets are identified. Example operations for computing are described below, for example, in reference to FIGS. 6A-6E and 8. Depending on the implementation, the smart music detection module 305 determine a first frame (e.g., of the state and/or a previous note onset), determine a second frame (e.g., of a current or new note onset), and may then determine a tempo based on the difference between the first and the second frames.

At 510, the smart voice enhancement engine 101 may validate the one or more tempos based on tempo validation condition(s). Example operations for validating tempos are described below, for example, in reference to FIGS. 6A-6E and 8. For instance, multiple tempo validation conditions, such as threshold ranges, tempo swing conditions, onset frequency conditions, etc., may be used to validate one or more tempos.

At 512, the smart voice enhancement engine 101 may determine one or more music states of a finite state machine based on the validated tempos. For example, a finite state machine may be implemented for tempo tracking to increase the music detection accuracy in the context of music, speech, and noise. The finite state machine may use multiple instances of tempo event detection, within specified time duration, in order to declare the final music detection. For instance, depending on tempos determined and conditions satisfied, the smart music detection module 305 may determine a current state of the finite state machine, as described in further detail in reference to FIGS. 6A-6E.

The finite state machine may include plural R music states. The finite state machine may transition between states based on tempo events detected and, in some implementations, based on other conditions, as described in further detail herein. Additionally, the smart music detection module 305 may reset or reduce the state of the finite state machine based on other conditions, such as a failure of onset or tempo validation conditions. Example states and transitions between states of the finite state machine are illustrated in FIG. 4.

At 514, the smart voice enhancement engine 101 may declare that the audio signal includes music based on the one or more music states, for example, based on a specific state of a finite state machine. For example, the smart music detection module 305 may declare that the audio signal includes music based on a transition of the one or more states to a final state of the finite state machine, such as is described in reference to FIG. 6D.

At 516, the smart voice enhancement engine 101 may modify audio enhancement of the audio signal based on the music declaration and/or music states. For example, if music is detected, the smart music detection module 305 may transmit a signal indicating the music detection to the SNC module 307, AEC module 311, or SLC module 313, which may cease or modify audio enhancement for a duration of the detected music. For example, smart voice enhancement engine 101 may cease noise cancelation of the audio signal during the frames that include detected music.

FIGS. 6A through 6E are flowcharts of an example method for detecting music in an audio signal.

At 602, the smart music detection module 305 may set a finite state machine to initial state ($S_0$). In some implementations, the smart music detection module 305 may calculate the spectral novelty functions (9) and (11) for each frame at state $S_0$. In frames where $\Gamma 1(m)$ or $\Gamma 2(m)$ are big enough (e.g., satisfying a defined threshold), the frame may satisfy note onset detection conditions.

At 604, the smart music detection module 305 may set a state duration or state life to a defined length based on a maximum tempo. For instance, the initial state duration state_duration or state life time may be set to the maximal length TEMPO_MAX. For instance, the smart music detection module 305 may use a tempo range between 300 milliseconds to 1 second, corresponding to minimal tempo TEMPO_MIN=30 and maximal tempo TEMPO_MAX=100 for a frame time of 10 milliseconds. In some implementations, for the initial state, $S_0$, the state duration may be set to an infinite duration, so that it continues to process frames until a note onset is found or the audio signal terminates.

At 606, the smart music detection module 305 may perform an analysis on a frame (e.g., of a current frame) of the audio data to detect a valid note onset. Example operations for detecting a valid note onset are described elsewhere herein, for example, in reference to FIGS. 5 and 7. Depending on the implementation, the smart music detection module 305 may use a known onset model where a note onset has attack, decay, sustain, and release phases. A music note onset normally lasts, for example, 30-60 milliseconds. For example, if the smart music detection module 305 determines that a score of the novelty function is higher than a threshold TT_MIN_SCORE (e.g., one) then the smart music detection module 305 may analyze the next two frames to find the maximum novelty function score. For example, the smart music detection module 305 may select the maximum score among a sequence of consecutive frames (e.g., three frames), to define the note onset and an associated frame number as the note onset frame. The frame number at which the maximum score and note onset is detected is denoted by fr_lock for the current note onset and music state of the finite state machine.

At 608, the smart music detection module 305 may determine whether a note onset was detected at 606 for a given frame. If no note onset was detected in the frame, the smart music detection module 305 may proceed, at 610, to analyze the next frame. If a note onset was detected in a given frame, the smart music detection module 305 may proceed to 612.

At 612, the smart music detection module 305 may set the finite state machine to an initial tempo detection state ($S_1$).

At 614, the smart music detection module 305 may set a state duration to a defined length based on maximum tempo. For instance, the initial state duration state_duration or state life time may be set to the maximal length TEMPO_MAX For instance, the smart music detection module 305 may use a tempo range between 300 milliseconds to 1 second, corresponding to minimal tempo TEMPO_MIN=30 and maximal tempo TEMPO_MAX=100 for a frame time of 10 milliseconds. In some implementations, the smart music detection module 305 may set the new state duration to the maximal length TEMPO_MAX plus a search margin (e.g., 5% or 10% of TEMPO_MAX).

At 616, the smart music detection module 305 may perform analysis on a current frame of audio data to detect valid note onset, for example, as described in reference to 606.

At 618, the smart music detection module 305 may determine whether a note onset is detected in the frame. If no note onset was detected in the frame, the smart music detection module 305 may proceed, at 620, to incrementally decrease the state duration state_duration by one frame time/duration, thereby allowing the state duration to run out (after all frames in the state duration/life are processed). At 622, the smart music detection module 305 may determine whether the state duration has elapsed. In instances that the state duration/life time runs out at state $S_1$ (e.g., state_duration=0), but a valid note onset does not show up in the frame, then the smart music detection module 305 may reset the finite state machine, so that the state goes back to the initial state $S_0$.

If the smart music detection module 305 determines, at 622, that the state duration has not elapsed, the smart music detection module 305 may proceed, at 624, to analyze the next frame.

If, at 618, the smart music detection module 305 determines that a note onset was detected in the given frame, the smart music detection module 305 may proceed to 626, at which the smart music detection module 305 may determine an initial tempo based on the detected valid note onset, for instance, as described in reference to 508 in FIG. 5.

At 628, the smart music detection module 305 may set the finite state machine to the next state. In some implementations, when a valid new note onset is detected and the smart music detection module 305 determines the initial tempo tempo_locked, the finite state machine moves to the next state, for example, the tempo validation state $S_2$. In some instances, a frame number at which a valid note onset is determined and the finite state machine transitions to the next state may be referred to herein as a state frame number, denoted by state_fr, and the associated tempo is called locked tempo tempo_locked for the finite state machine. The associated onset score of the determined note onset may be referred to herein as the state score at frame state_fr.

At 630, the smart music detection module 305 may set a state duration for the current state (e.g., $S_i$) to defined length based on locked tempo plus defined margin. In some implementations, a new state duration state_duration for states $S_2$-$S_6$ may be set to the locked tempo tempo_locked plus a search margin. For example, the search margin may be 5% or 10% of TEMPO_MAX (e.g., for $S_1$ or $S_2$) or of tempo_locked (e.g., for $S_3$-$S_6$), although other implementations are possible and contemplated herein.

At 632, the smart music detection module 305 may perform analysis on a current frame of audio data to detect valid note onset, for example, as described in reference to 606.

At 634, the smart music detection module 305 may determine whether a note onset is detected in the frame. If no note onset was detected in the frame, the smart music detection module 305 may proceed, at 636, to incrementally decrease the state duration state_duration by one frame time/duration. At 638, the smart music detection module 305 may determine whether the state duration has elapsed.

In case that the state duration/life time runs out at for the state $S_i$ (e.g., state_duration=0), but a valid note onset does not show up in the frame, then the smart music detection module 305 may determine, at 642, whether the state is in a defined set of states. For example, as illustrated in FIG. 4, some states ($S_3$-$S_6$) may be in a set of states after the expiration of state duration, a legato state is entered to search for a legato tempo. Accordingly, if the state duration elapses, but the current state is in a defined set (e.g., set at 628 or 656), the smart music detection module 305 may proceed to 664 in FIG. 6E, described below, at which the smart music detection module 305 may calculate a new legato tempo in a legato state where a note lasts a multiple of the tempo length and verify that the new legato tempo satisfies a tempo swing condition. For example, starting from state $S_3$ until state $S_6$, if the state duration/life time runs out, the finite state machine may move to a new state $S_8$, representing legato state, which is a special state to detect musical phenomenon, such as legato in the audio signal. Legato is a special music phenomenon where a note lasts multiple tempos length.

If, at 642, the current state is not in the defined set, the smart music detection module 305 may reset the finite state machine, so that the state goes back to the initial state $S_0$.

If the smart music detection module 305 determines, at 638, that the state duration has not elapsed, the smart music detection module 305 may proceed, at 640, to analyze the next frame.

If, at 634, the smart music detection module 305 determines that a note onset was detected in the given frame, the smart music detection module 305 may proceed to 644, at which the smart music detection module 305 may determine a new tempo for the state based on the detected valid note onset, for instance, as described in reference to 508 in FIG. 5.

At 646, the smart music detection module 305 may validate the new tempo based on tempo validation conditions, for example, as described in further detail below in reference to FIG. 8.

At 648, the smart music detection module 305 may determine whether the tempo validation conditions have been satisfied and, if the conditions were not satisfied (e.g., that the new tempo is not valid) the smart music detection module 305 may proceed, at 640, to analyze the next frame. If the conditions are satisfied, the smart music detection module 305 may proceed to 650.

At 650, the smart music detection module 305 may determine whether the state is eligible for acceleration to the final state of the finite state machine, which may decrease the music detection time. For example, in some implementations, the smart music detection module 305 may determine whether the detected tempos across the states of the finite state machine satisfy a tempo swing condition in order to determine whether the state may be accelerated, for example, by skipping one or more states of the finite state machine. For instance, the smart music detection module 305 may determine that a plurality of the tempos satisfy a tempo swing condition, which indicates whether a range of the plurality of the tempos satisfy a determined tempo swing condition threshold. If the tempo swing condition threshold is satisfied, the smart music detection module 305 may transition the finite state machine from a first state to a second state. In some implementations, the smart music detection module 305 may skip one or more states or operations thereof (e.g., tempo validation conditions) based on the state being eligible for acceleration, such as from a state $S_2$ to a state $S_4$, as illustrated in FIG. 4 and as described in further detail below.

In some implementations, the smart music detection module 305 may use a threshold onset score TT_MIN_SCORE (e.g., TT_MIN_SCORE=one) to verify whether a note onset is valid. Depending on the implementation, the threshold onset score may be used for states except state $S_0$. In order to discriminate noise and speech, at $S_0$ the smart music detection module 305 may use a different threshold TT_GATE_SCORE (e.g., TT_GATE_SCORE=two).

The smart music detection module 305 may store a note onset frame number fr_lock for each note onset in memory, for example, in an array hist[ ], where hist[0] is the latest note onset frame number, hist[i] is the frame number of the previous i-th note onset. The smart music detection module 305 may determine a particular tempo using $$\text{tempo_locked}=\text{hist}[0]-\text{hist}[1]. \tag{12}$$

Similarly, a plurality of tempos for multiple state of the finite state machine can be determined. For example, the previous three tempos can be calculated as follows:

$$\text{tempo1}=\text{hist}[1]-\text{hist}[2], \tag{13}$$

$$\text{tempo2}=\text{hist}[2]-\text{hist}[3], \tag{14}$$

$$\text{tempo3}=\text{hist}[3]-\text{hist}[4]. \tag{15}$$

In the example, if the smart music detection module 305 determines that tempo1 satisfies the swing condition in (27)-(28) defined later, then both tempo_locked and tempo1 may be valid tempos and the smart music detection module 305 may move the state of the finite state machine (e.g., to $S_3$). Similarly, in the case that both tempo1 and tempo2 satisfy the swing condition in (27)-(28), the smart music detection module 305 may move the state of the finite state machine again (e.g., to $S_4$). Furthermore, in the case that tempo1, tempo2, and tempo3 satisfy the swing condition in (27)-(28), then the smart music detection module 305 may move the state of the finite state machine even further (e.g., to $S_5$).

If, at 650, the determination that the states are eligible for acceleration is positive, the smart music detection module 305 may accelerate the state of the final state machine to the determined accelerated state at 652. For example, if tempo0 (e.g., detected in state $S_1$), tempo1 (e.g., detected in state $S_2$), tempo2 (e.g., detected in state $S_3$), and tempo3 (e.g., detected in state $S_4$) satisfy the tempo swing condition, the smart music detection module 305 may move the state of the finite state machine an equal number of states, such as through to $S_5$.

It should be noted that, in the tempo range between 300 milliseconds to 1 second, it is possible that locked tempo is twice a smaller tempo: tempo_half=tempo_locked/2. In such instances, both tempo1 and tempo2 may satisfy the swing condition in (27)-(28) with the half tempo tempo_half. In these instances, the smart music detection module 305 may move the state of the finite state machine (e.g., to $S_4$) and set the locked tempo to the new half tempo tempo_half.

In some implementations, the smart music detection module 305 may determine a novelty function score for each state $S_i$, $1 \le i \le 8$ at the state frame state_fr, for example, based on the table depicted in FIG. 10. The smart music detection module 305 may accumulate the onset score across the states and saved it in memory as tt_score. In some implementations, a total music factor score may be used to accelerate from a given state to the final state. For instance, at state $S_5$, the total tempo tracking score tt_score may be used to verify the following condition $$tt_\text{score} \ge TT_\text{PASS_SCORE}, \tag{16}$$

where TT_PASS_SCORE is a constant (e.g., 80 or 100).

For example, in order to transit from $S_5$ to the music detection state $S_7$, the smart music detection module 305 may calculate a music factor. Similar to (9) and (10), a high frequency component (HFC) novelty function may be defined as follows $$\Gamma 3(m) = \sum_{i=0}^{N_c-1} \|EdB(m, i) - EdB(m-1, i)|_{\geq 0} - \mu(m, i)|_{\geq 0} * \text{HFC_weight}[i], \quad (17)$$

$$\Gamma 4(m) = \sum_{i=0}^{N_c-1} \|EdB(m, i) - EdB(m-2, i)|_{\geq 0} - \xi(m, i)|_{\geq 0} * \text{HFC_weight}[i], \quad (18)$$

where the high frequency component weights HFC_weight[i], $0 \leq i < N_c$ are given in column 4 of the table 901 illustrated in FIG. 9. Corresponding to Γ3(m) and Γ4(m), the music factor may be obtained from the table 1001 illustrated in FIG. 10. This music factor score is accumulated across all states and is saved in memory tt_music_score. In some implementations, a total music factor score may be used to accelerate from a given state to the final state. For instance, at state $S_5$, the smart music detection module 305 may use the total music factor score tt_music_score to verify the following condition $$tt_\text{music_score} \geq \text{MUSIC_PASS}, \quad (19)$$

where MUSIC_PASS is a constant (e.g., 15, 30, or 45). At state $S_5$, if the conditions (16), (19), and (20) are satisfied, then the smart music detection module 305 may transit the finite state machine to the music detection state $S_7$. If any of the conditions (16), (19a), and (20) are not satisfied, the smart music detection module 305 may transit the finite state machine transits from state $S_5$ to state $S_6$, for example, for continued processing.

In some implementations, the smart music detection module 305 may determine a total onset score and/or total music factor score. For example, the smart music detection module 305 may determine whether a total onset score satisfies a first threshold. As described above, an onset score may represent a signal energy of a note onset. The smart music detection module 305 may additionally or alternatively determine whether a total music factor score satisfies a second threshold. The music factor score may represent a high-frequency component of the note onset. The smart music detection module 305 may transition a finite state machine to a final state based on the total onset score satisfying the first threshold and the total music factor score satisfying the second threshold.

At 654, the smart music detection module 305 may determine whether the next state is the final state, for example, the final state may be the music detected state $S_7$, which may be the next state if a current state is $S_6$.

If the next state is not the final state, at 656, the smart music detection module 305 may set the finite state machine to the next state ($S_i$) after a current state, for example, if a state being processed is $S_3$, the next state would be $S_4$, as illustrated in FIG. 4. The smart music detection module 305 may then proceed through the analysis illustrated in FIG. 6C for the next state.

If, at 654, the smart music detection module 305 determines that the next state is the final state, in some implementations, at 658, it may perform a final validation condition check. It should be noted that, depending on the implementation, there may be three possible routes that the music detection state $S_7$ can be reached: from state $S_6$ with a valid tempo detection, from state $S_5$ with accelerated music detection, and from the legato state $S_8$.

In some implementations, the smart music detection module 305 may determine the one or more music states based on whether the average length between two onsets is bigger than a threshold. For instance, the smart music detection module 305 may compute an average quantity of the set of frames between note onsets in the identified plurality of note onsets. The smart music detection module 305 may determine whether the average quantity of the set of frames between the note onsets satisfies a threshold length. Responsive to determining that the average quantity does not satisfy the threshold length, the smart music detection module 305 may set the one or more music states to an initial state (e.g., $S_0$), which indicates that music has not been detected in the audio signal.

For example, at each state $S_i$, $1 \leq i \leq 8$, if the note onset passes the onset profile verification, the smart music detection module 305 may increase an onset detection counter onset_cnt by one. This counter onset_cnt is accumulated across all states. The state frame state_fr of the $1^{st}$ state $S_1$ may be denoted herein by fr_initial. Before the transition to the music state $S_7$, fr_lock−fr_initial is the total time duration since the $1^{st}$ state $S_1$. Too many onsets during this time period mean that noise is present, so the smart music detection module 305 may verify whether the audio signal includes noise using the following condition $$fr_\text{lock} - fr_\text{initial} > \text{onset}_cnt * \text{OS_MIN_LEN}, \quad (20)$$

where OS_MIN_LEN is a constant representing the minimal average length between two onsets (e.g., 15, 18, or 20 for a 10 ms frame time). If the smart music detection module 305 determines that the condition (20) is not satisfied then (e.g., from states $S_6$ and $S_8$) the smart music detection module 305 may reset the finite state machine by moving it back to the initial state $S_0$. If the smart music detection module 305 determines that the condition (20) is satisfied, it may move the finite state machine to the music detection state $S_7$, at which state the smart music detection module 305 declares that music is detected in the frames of the audio signal.

At 660, the smart music detection module 305 may determine whether the final validation check has been satisfied. If the final check was not satisfied, the smart music detection module 305 may reset the finite state machine to an initial state $S_0$. If the final check was satisfied, the smart music detection module 305 may, at 662, set the finite state machine to a final state, which may also be referred to herein as the music detected state based upon which the smart music detection module 305 may declare that the audio signal includes music.

Figure 6A:
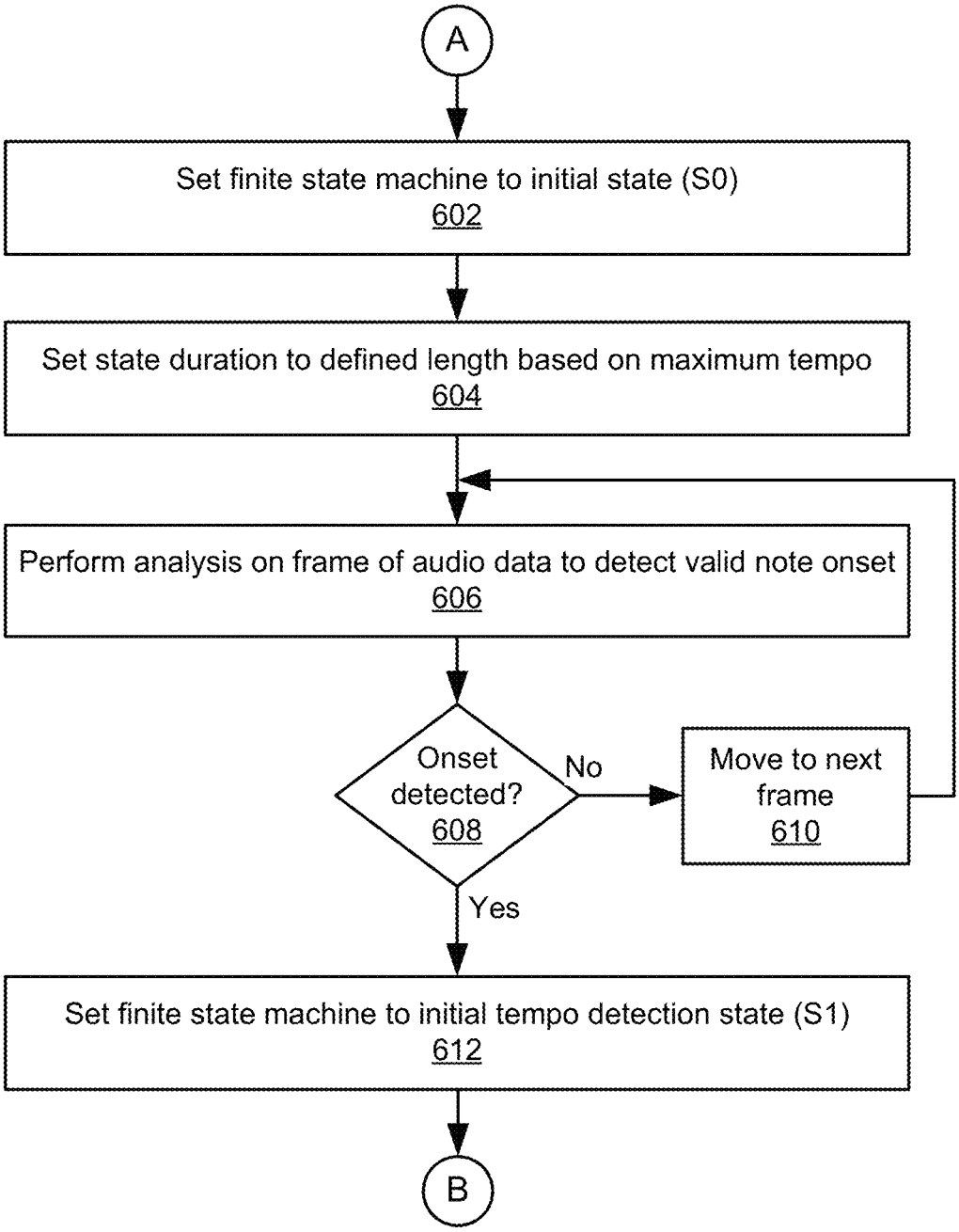
FIGS. 6A through 6E are flowcharts of an example method for detecting music in an audio signal.
Figure 6B:
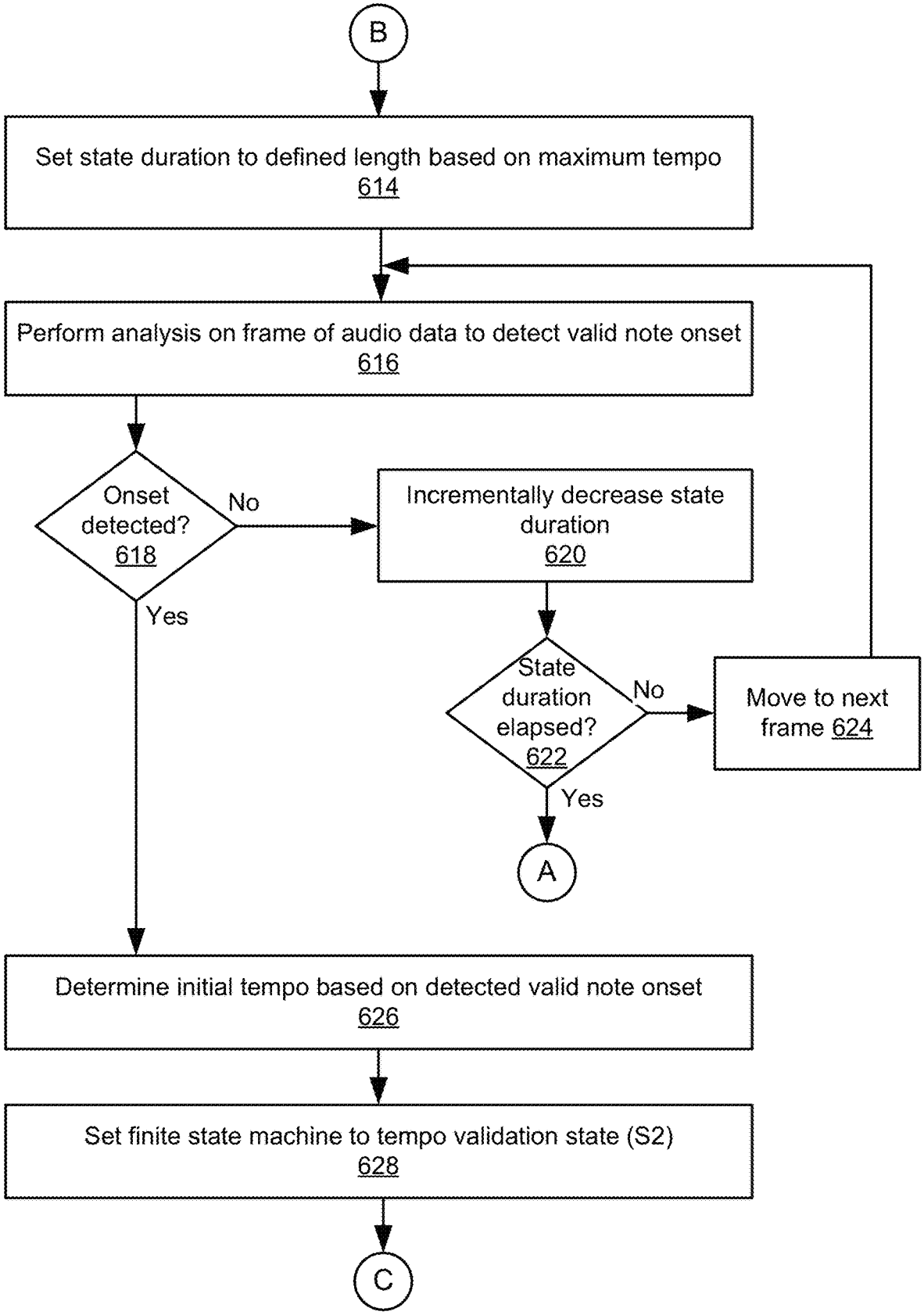
Figure 6C:
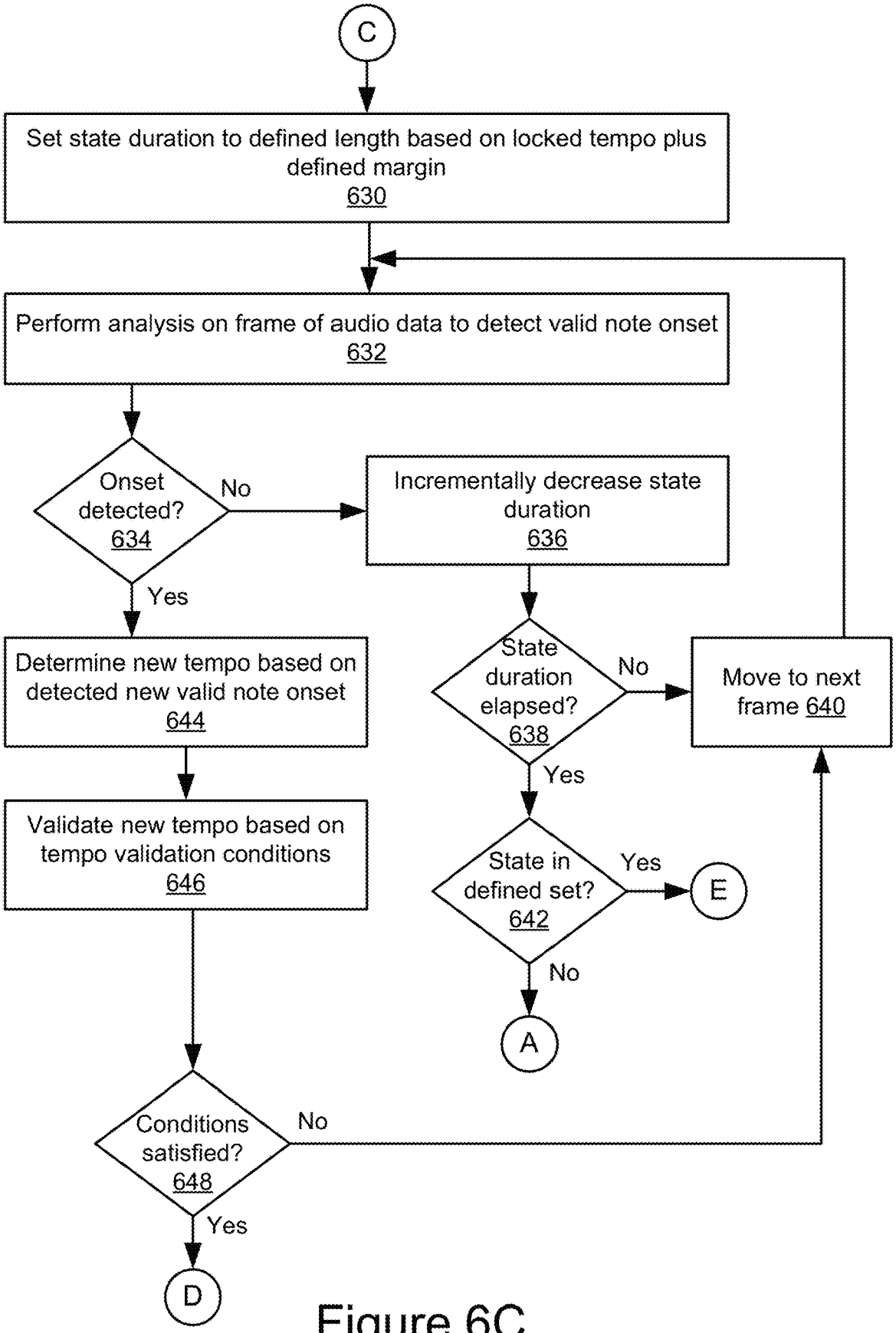
Figure 6D:
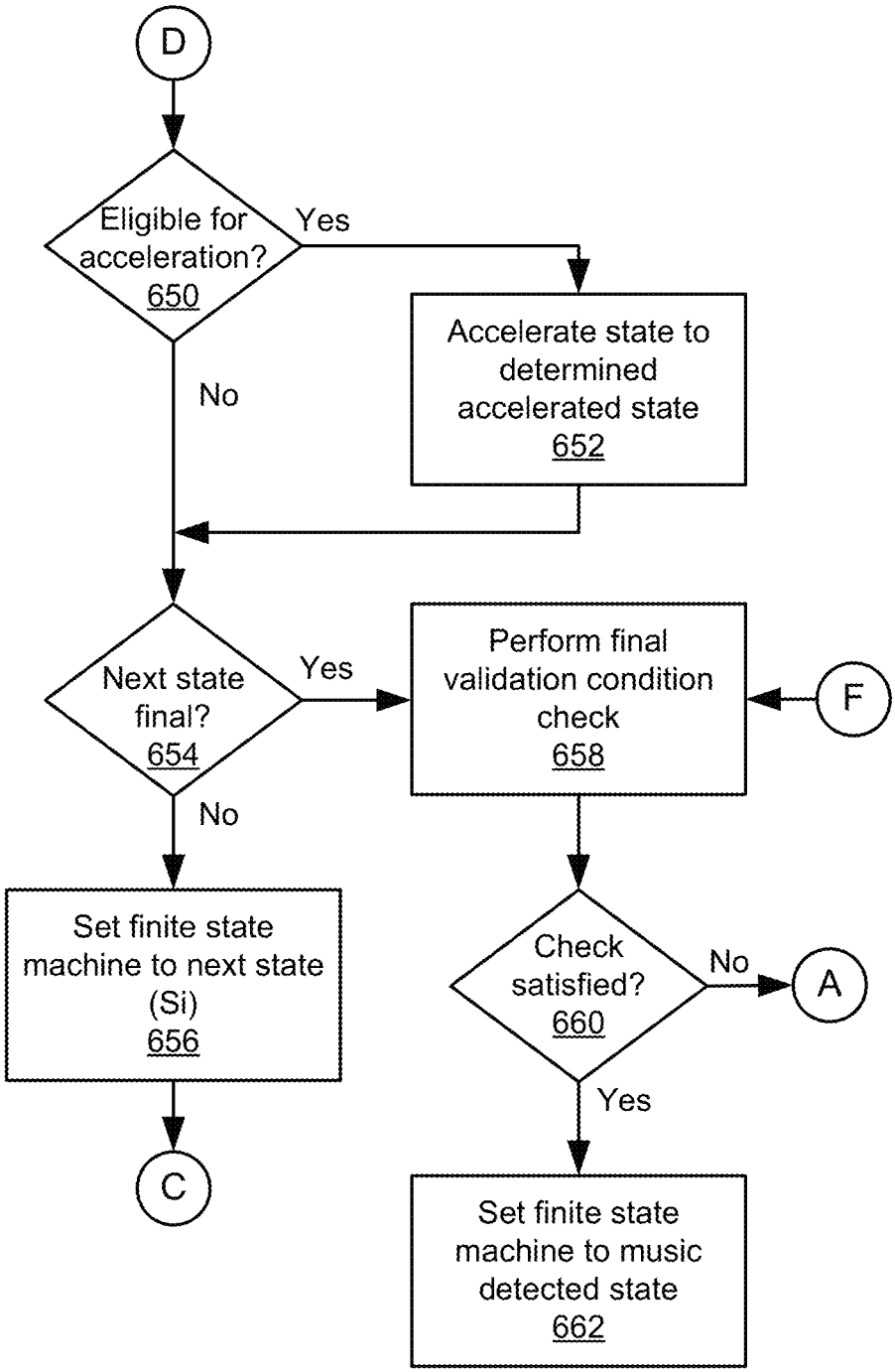
Figure 6E:
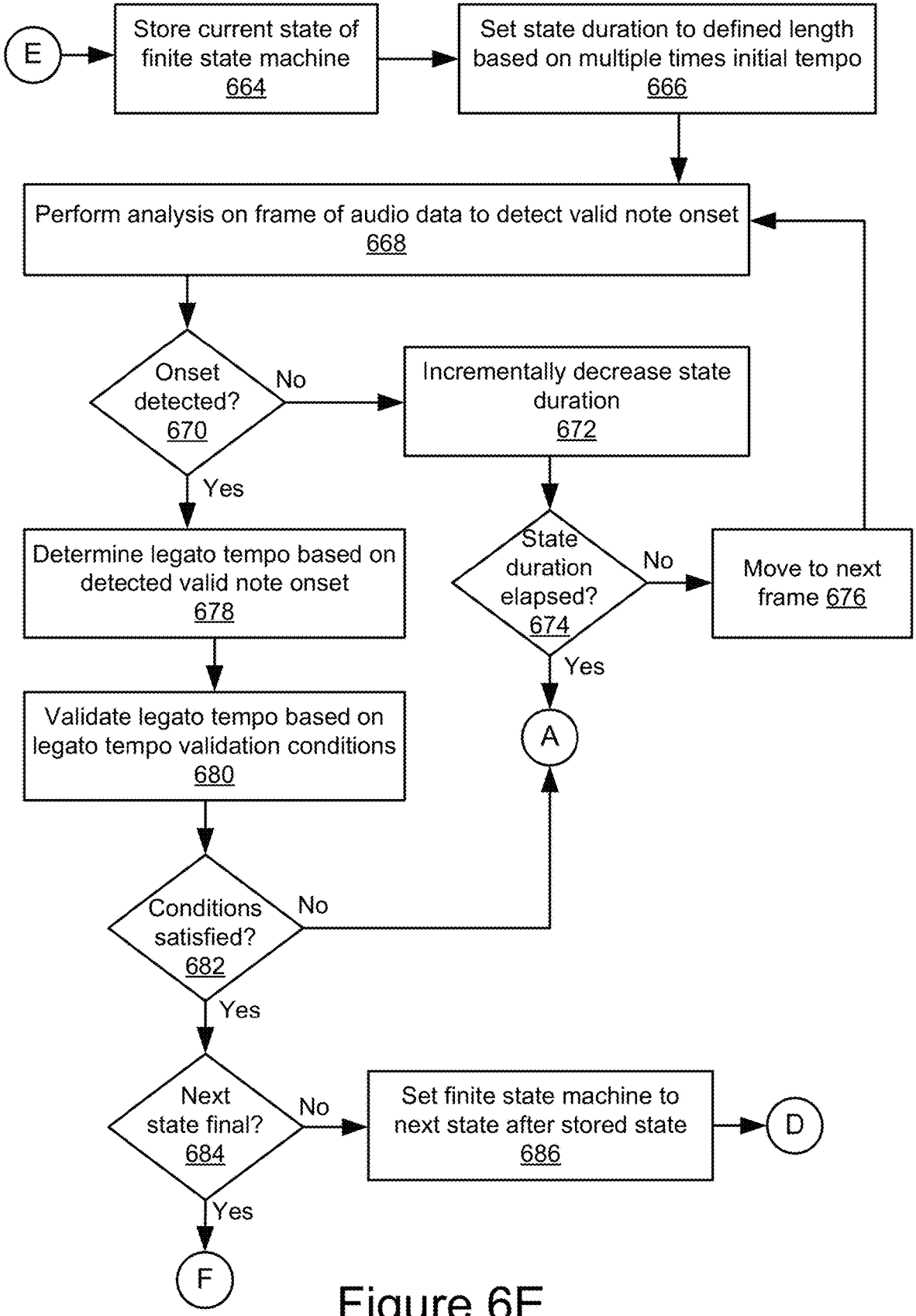

Referring to FIG. 6E, the operations of which may be performed, for example, in response to an expiration of a state duration and a determination that a state may transition to a legato state $S_8$, as described in reference to 638 and 642 above. For instance, smart music detection module 305 may detect that a state duration of a particular music state has elapsed and transition the finite state machine to a legato tempo detection state.

In some implementations, at 664, the smart music detection module 305 may store current state of finite state machine in memory. For instance, before entering the legato state $S_8$ from a current state $S_i$, the current state $S_i$ is saved to a previous state variable tt_prestate, where tt_prestate is an instance of tTT_STATE.

At 666, the smart music detection module 305 may set the state_duration to defined length based on multiple times the initial tempo. For instance, the smart music detection module 305 may set the new state duration state_duration for the legato state $S_8$ to multiple times the locked tempo tempo_locked (e.g., 4 or 6 times as long). The smart music detection module 305 may use the legato state $S_8$ to detect a special music phenomenon called legato, in which a note lasts multiple tempo lengths.

At 668, the smart music detection module 305 may perform an analysis on a current frame of audio data to detect valid note onset while in the legato tempo detection state $S_8$, for example, as described in reference to 606.

At 670, the smart music detection module 305 may determine whether a note onset has been detected in the frame. If no note onset was detected in the frame, the smart music detection module 305 may proceed, at 672, to incrementally decrease the state duration of the legato state by one frame time/duration. At 674, the smart music detection module 305 may determine whether the state duration has elapsed. In instances that the state duration/life time runs out at state $S_8$ (e.g., state_duration=0), but a valid note onset does not show up in the frame, then the smart music detection module 305 may reset the finite state machine, so that the state goes back to the initial state $S_0$.

If the smart music detection module 305 determines, at 674, that the state duration has not elapsed, the smart music detection module 305 may proceed, at 676, to analyze the next frame.

If, at 670, the smart music detection module 305 determines that a note onset was detected in the given frame, the smart music detection module 305 may proceed to 678, at which the smart music detection module 305 may determine a legato tempo based on the detected valid note onset, for instance, as described in reference the tempo determination above.

For example, the smart music detection module 305 may calculate the new tempo by subtracting the previous state frame number state_fr from note onset frame number fr_lock, where state_fr is the state frame of $S_i$. In some implementations, the smart music detection module 305 may search the distance between the new tempo and multiples of tempo_locked, $$m*\text{tempo_locked}, 2 \le m \le \text{LEGATO_LENGTH}, \tag{21}$$

where LEGATO_LENGTH is a constant (e.g., five or eight).

At 680, the smart music detection module 305 may validate the determined legato tempo based on legato tempo validation conditions. In some instances, the smart music detection module 305 may validate the potential legato tempo based on a multiple of an initial tempo of the one or more tempos. For example, in the legato state $S_8$, the onset detection procedure, the onset profile verification, and the tempo swing condition may be determined in the same way as described above in reference to the non-legato states. In some instances, the onset frequency condition may detect solely one onset during the duration of the legato state. Once a note onset shows up, the smart music detection module 305 may verify the special tempo verification condition.

From (21), the allowed tempo margin may be defined as follows:

$$m \text{ arg } in_\text{allowed} = m*\eta*\text{tempo_locked}, \tag{22}$$

where $\eta$ is a constant (e.g., 5% or 10%) and m may be replaced by a constant LEGATO_CONST (e.g., two or three). If the smart music detection module 305 determines that the distance (e.g., in a quantity of frames) satisfies the following condition $$|(fr_\text{lock-state}_fr) - m*\text{tempo_locked}| \le m \text{ arg } in_\text{allowed}, \tag{23}$$

for some m where $2 \le m \le$ LEGATO_LENGTH, then the tempo verification condition may be passed. The new legato tempo may be defined as the nearest integer to (fr_lock-state_fr)/m:

$$\text{legato_tempo} = \text{round}((fr_\text{lock-state}_fr)/m). \tag{24}$$

In some implementations, the smart music detection module 305 may use the new legato_tempo to verify the tempo swing condition, as described above.

At 682, the smart music detection module 305 may determine whether the legato tempo validation conditions described in reference to 680 are satisfied. If the conditions are not satisfied, the smart music detection module 305 may reset the finite state machine to the initial state $S_0$.

If the smart music detection module 305 determines, at 682, that the conditions are satisfied, the smart music detection module 305 may determine whether the next state in the finite state machine is the final state at 684. If the next state is a final state (e.g., $S_7$), the smart music detection module 305 may proceed to 658 described in reference to FIG. 6E.

If the next state is not a final state, the smart music detection module 305 may, at 686, the smart music detection module 305 may set the finite state machine to next state after the stored state. For example, in instances where a valid note onset is found and the tempo satisfies the tempo verification condition (23) and the tempo swing condition (27)-(28) in the legato state $S_8$, then the finite state machine moves to the next state (tt_prestate+1), in this case, $S_{i+1}$.

Figure 7:
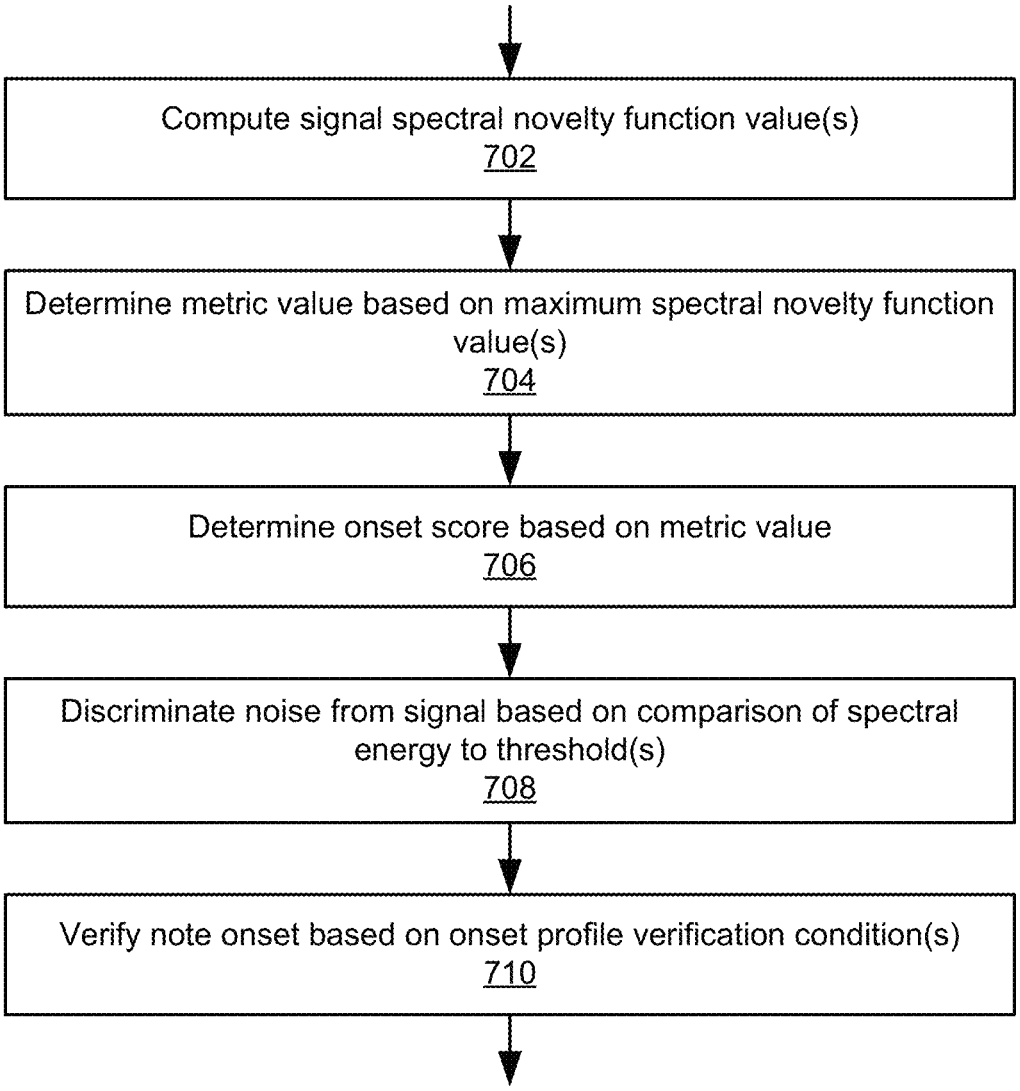
FIG. 7 is a flowchart of an example method for determining a valid note onset.

FIG. 7 is a flowchart of an example method for determining a valid note onset. The operations described in reference to FIG. 7 may be applicable to a typical state $S_i$, $1 \le i \le 6$ of the finite state machine, for example, as described in reference to FIGS. 5-6E, although various states may include additional or fewer operations, for example, as described above.

At 702, the smart music detection module 305 may compute signal spectral novelty function value(s), for example, as described above. For instance, the smart music detection module 305 may calculate the signal spectral novelty functions based on the first-order difference and the second-order difference of the power spectral density in dB domain, as described above. The smart music detection module 305 may compute the note onset score based on a table and the spectral novelty functions, for example, as described above. Similarly, as described above, the smart music detection module 305 may detect a valid note onset based on note onset score, the signal spectral energy, and the averaging signal spectral energy.

In some implementations, at 704, the smart music detection module 305 may determine a metric value based on maximum spectral novelty function value(s). For instance, the smart music detection module 305 may detect a note onset detection as follows. After obtaining the signal spectral novelty functions $\Gamma1(m)$ and $\Gamma2(m)$ defined in (8)-(11), the smart music detection module 305 may find the maximum $$\text{metric} = \max(\Gamma1(m), \Gamma2(m)). \tag{25}$$

At 706, the smart music detection module 305 may determine onset score based on a metric value. For example, the smart music detection module 305 may use the determined metric value to get an onset score from the column 2 of the table 1001 described in FIG. 10, which illustrates an example table 1001 with metric scores, onset scores, and music factors. The metric value described in FIG. 10 uses the Q5 format, which means the thresholds are divided by 32 to get the true dB value. For example, 1000 in the table 1001 means 1000/32=31.25 dB. According to this table 1001, the metric value (25) in the range [2000, 3000) may receive an onset score of two. The table 1001 in FIG. 10 may be used by the smart music detection module 305 to define precise note onset position in terms of audio frame number.

As described above, the smart music detection module 305 may determine the note onset frame based on the maximum onset score among a sequence of frames.

At 708, the smart music detection module 305 may discriminate noise from signal based on comparison of spectral energy to threshold(s). In some implementations, the smart music detection module 305 may validate note onset based on note onset score, the signal spectral energy, and the averaging signal spectral energy.

In some implementations, to further discriminate music against noise and speech, for a valid note onset, the smart music detection module 305 may use that the signal spectral energy (6) is bigger than a threshold ETOT_THR (e.g., −50 dBm, −55 dBm, or −60 dBm). We also use that the signal spectral energy (6) is bigger than an averaging spectral energy (e.g., a comparison of spectral energy per frame) minus a threshold EDB_ONSET_MARGIN (e.g., 18 dB). The averaging spectral energy is defined in reference to (29) herein.

At 710, the smart music detection module 305 may verify a note onset based on onset profile verification condition(s). For example, the smart music detection module 305 may perform onset profile verification based on the distance between a current onset frame and previous state frame, the signal spectral energy in dB domain of the subsequent three frames, and/or performing the tempo verification such that the new tempo is close to the locked tempo.

The smart music detection module 305 may validate the note onset based on onset profile verification condition(s). First, the smart music detection module 305 may determine that a current note onset frame fr_lock has enough distance from the previous state frame number state_fr, for example, a constant MIN_INTERVAL frames away (e.g., MIN_INTERVAL=5). If the current note onset frame does not have a threshold distance, the smart music detection module 305 may determine that the sound includes noise. For example, in the case that fr_lock is within MIN_INTERVAL frames from the previous state frame number state_fr, and the current onset score is bigger than previous state score, then the smart music detection module 305 may determine that the current onset is not a valid note onset and it may reset the finite state machine moves the state to the original state $S_0$.

In some implementations, validating a note onsets may include determining a quantity of the set of frames between a first frame of a particular state of the one or more music states and a frame in which a particular note onset is detected. The smart music detection module 305 may determine that the quantity of the set of frames between the first frame and the frame of the particular note onset satisfies a defined threshold and, responsive to determining that the quantity of frames satisfies the defined threshold, the smart music detection module 305 may set the one or more music states to an initial state $S_0$.

Second, in some implementations, the smart music detection module 305 may determine that a first frame has signal spectral energy (6) bigger than the threshold ETOT_THR, but the minimum of the subsequent two frames is smaller than ETOT_THR, then the smart music detection module 305 may determine that a current audio frame is not a valid note onset. Furthermore, if the smart music detection module 305 determines that a minimum of the subsequent two frames is smaller than ETOT_THR minus a threshold BUBBLE_OFFSET (e.g., BUBBLE_OFFSET=1 dB, etc.), then the smart music detection module 305 may determine that the current audio frame may include a noise bubble. In this case, the smart music detection module 305 may reset the finite state machine and move to the original state $S_0$.

Figure 8:
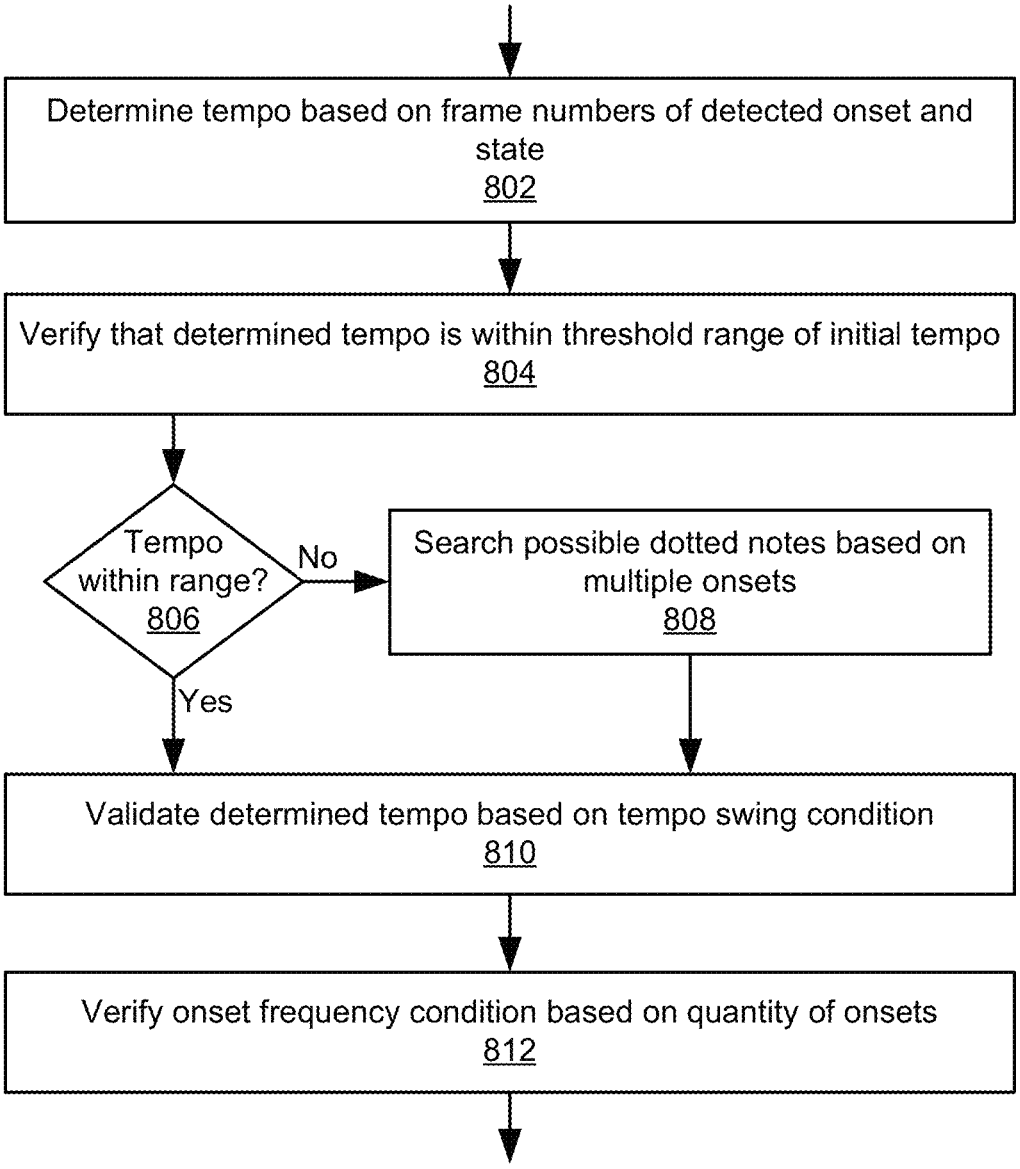
FIG. 8 is a flowchart of an example method for determining a valid tempo, for example, based on verification conditions.

FIG. 8 is a flowchart of an example method for determining a valid tempo, for example, based on one or more tempo verification conditions. At 802, the smart music detection module 305 may determine a tempo based on frame numbers of the detected onset and state, for example, the smart music detection module 305 may obtain the new tempo by subtracting the previous state frame number state_fr from a current note onset frame fr_lock. It should be noted that a note onset may have a duration of about 30-50 milliseconds (e.g., a 30 millisecond model may be used herein), although other durations are possible. The distance between the current note onset frame fr_lock and the previous state frame state_fr is defined as the new tempo. Suppose that state frame state_fr=n, then the $1^{st}$ frame of the current state is frame n+1. If, for example, the new tempo is 50, then n+50 is the current note onset. Accordingly, the smart music detection module 305 may determine the new tempo (e.g., (n+50)−n).

At 804, the smart music detection module 305 may verify that the determined tempo is within a threshold range of the initial tempo. For example, the smart music detection module 305 may determine whether the detected new tempo is within a threshold (e.g., 10%) distance to the previous locked tempo tempo_locked. If the detected tempo is within the threshold, then the detected tempo passes the tempo verification condition. If the detected tempo is not within the threshold, the smart music detection module 305 may continue to search the next frame(s) until the state duration runs out, for example, as described in reference to FIGS. 6A-6E.

At 806, the smart music detection module 305 may determine whether the determined tempo is within the threshold range. In response to determining that the tempo is not within the threshold range at 806, the smart music detection module 305 may search possible dotted notes based on multiple note onsets at 808. The smart music detection module 305 may track a tempo for dotted notes by finding valid tempos among additional note onsets. Dotted notes occur frequently in music and, since dotted notes suddenly change the note duration, this increases difficulties to track the tempo changes. Accordingly, the smart music detection module 305 may perform operations for tracking tempos with dotted notes in one or more of the states (e.g., in state $S_2$, in states $S_2$-$S_6$, etc.).

For example, the smart music detection module 305 may determine that a second tempo differs from a first tempo by a threshold amount and, responsive to determining that the second tempo differs from the first tempo by greater than the threshold amount, the smart music detection module 305 may perform additional operations. For instance, the smart music detection module 305 may search for an additional note onset, determine a tempo for the additional note onset, and determine whether the tempo for the additional note onset satisfies a tempo swing condition, which indicates whether a range of the first tempo and the second tempo satisfy a determined tempo swing condition threshold.

For example, at state $S_2$, the smart music detection module 305 may have obtained a valid tempo tempo_locked, and the smart music detection module 305 may search for a new valid tempo matching tempo_locked in order to transit to the next state $S_3$. The smart music detection module 305 may determine the distance between state_fr and fr_lock to be the new tempo. In the case that this new tempo is close enough to tempo_locked, or multiples of tempo_locked, such as within a small margin such as 5% or 10% of tempo_locked, then a new valid tempo is found and the finite state machine transits to the next state (e.g., $S_3$). If, however, the new tempo does not satisfy the above tempo validation condition, then the smart music detection module 305 may search possible dotted notes. For instance, $$\text{tempo0}=\text{hist}[0]-\text{hist}[1]. \tag{26}$$

The smart music detection module 305 may use the definitions in (13)-(15). Depending on how many onsets are detected since the state frame state_fr in a state (e.g., $S_2$).

In some implementations, if there is one note onset, the smart music detection module 305 may continue to detect more onsets in the next audio frames.

If there are two note onsets, then the smart music detection module 305 may test whether temp0 and (temp1+tempo_locked) satisfy the swing condition (27)-(28). If the swing condition is satisfied, then the smart music detection module 305 may set the new locked tempo as (temp1+tempo_locked). The smart music detection module 305 may also move the finite state machine to the next state (e.g., $S_3$).

If there are three note onsets since the state frame state_fr, then the smart music detection module 305 may analyze then, for instance, the smart music detection module 305 may analyze the following two different combinations:

1) Both tempo0 and tempo_locked+tempo1+tempo2 satisfy the swing condition (27)-(28)
2) Both tempo0+tempo1 and tempo_locked+tempo2 satisfy the swing condition (27)-(28)

If either condition 1) or 2) is satisfied, then the smart music detection module 305 may set the locked tempo as tempo0 and (tempo+tempo1), for example. The smart music detection module 305 may also move the finite state machine to the next state (e.g., $S_3$).

At 810, the smart music detection module 305 may validate the determined tempo based on a tempo swing condition. For instance, the smart music detection module 305 may verify that that the distance between a maximum and a minimum tempo is smaller than a threshold. If the distance is greater than a threshold, the smart music detection module 305 may reset the finite state machine to the initial state $S_0$.

For the current state $S_i$, there are (i−1) tempos accumulated over the set of states. The smart music detection module 305 may determine a minimum tempo and a maximum tempo of the set of tempos, which may respectively be denoted as tempo_min and tempo_max, respectively. The smart music detection module 305 may determine a difference between the maximum tempo and the minimum tempo, for example, using the tempo swing, which may be defined as follows:

$$\text{tempo_swing}=\text{tempo_max}-\text{tempo_min}. \tag{27}$$

In some implementations, the smart music detection module 305 may determine a tempo swing condition threshold based on an initial tempo and a defined multiplier. For instance, the tempo swing condition be represented by $$\text{tempo_swing}\leq\eta*\text{tempo_locked}, \tag{28}$$

where η is a constant (e.g., 5% or 10%). The smart music detection module 305 may determine that the difference satisfies the tempo swing condition threshold. If condition (28) is not satisfied, then the tempo varies too much and the smart music detection module 305 may reset the finite state machine and it moves back to the original state $S_0$.

The smart music detection module 305 may, responsive to determining that the difference does not satisfy the tempo swing condition threshold (e.g., that the tempo swing condition (28) is not passed), set the one or more music states to an initial state, which indicates that music has not been detected in the audio signal.

If the tempo swing condition (28) is passed, then the smart music detection module 305 may transit the finite state machine to the next state $S_{i+1}$, for example, as described in reference to FIGS. 6A-6E. Before the transition, in some implementations, the smart music detection module 305 may calculate the averaging spectral energy EdB_avg(r) where r is an index indicating the state. For the $1^{st}$ state $S_1$, the EdB_avg(1) equals the total signal spectral energy in dB defined in (6) at the state frame state_fr. As such, at the r-th state, the averaging spectral energy may be calculated by the smart music detection module 305 as follows:

$$EdB_\text{avg}(r)=EdB_\text{avg}(r-1)+(1-\beta)EdB_\text{total}(r), \tag{29}$$

where β is a smoothing factor, $0\leq\beta<1$ (e.g., β=3/4 or β=7/8), and EdB_total(r) is the total signal spectral energy in dB defined in (6) at the r-th state frame.

In some implementations, at 812, the smart music detection module 305 may verify an onset frequency condition based on a quantity of note onsets. For example, the smart music detection module 305 may validate the one or more tempos based on computing a quantity of the identified plurality of note onsets during a period of a valid tempo. The smart music detection module 305 may determine that the quantity of the identified plurality of note onsets satisfies a defined threshold and, responsive to determining that the quantity of the identified plurality of note onsets satisfies the defined threshold, the smart music detection module 305 may set the music states to an initial state $S_0$, which indicates that music has not been detected in the audio signal. For example, during one tempo period, if there are more than FREQ_MAX onsets (e.g., FREQ_MAX=3), then the detected onsets are most likely noise rather than music. If the detected audio is noise, the finite state machine may be reset to the state $S_0$. If, on the other hand, the smart music detection module 305 determines that the number of onsets during one valid tempo is smaller than the threshold, the onset frequency condition may be passed, thereby validating the onset and/or frequency based on this condition.

As will be understood by those familiar with the art, the invention may be embodied in other specific forms without departing from the spirit or essential characteristics thereof. Likewise, the particular naming and division of the portions, modules, agents, managers, components, functions, procedures, actions, layers, features, attributes, methodologies, data structures, and other aspects are not mandatory, and the mechanisms that implement the invention or its features may have different names, divisions and/or formats. The foregoing description, for purpose of explanation, has been described with reference to specific examples. However, the illustrative discussions above are not intended to be exhaustive or limiting to the precise forms disclosed. Many modifications and variations are possible in view of the above teachings. The examples were chosen and described in order to best explain relevant principles and their practical applications, to thereby enable others skilled in the art to best utilize various examples with or without various modifications as may be suited to the particular use contemplated.

What is claimed is:

1. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition;

determining, by the computing device, one or more music states of the audio signal based on the validated one or more tempos; and modifying, by the computing device, audio enhancement of the audio signal based on the one or more music states, wherein modifying the audio enhancement of the audio signal comprises ceasing noise cancelation of the audio signal.

2. The computer-implemented method of claim 1, further comprising:

determining, by the computing device, one or more states of a finite state machine based on the validated one or more tempos; and declaring, by the computing device, that the audio signal includes music based on a transition of the one or more states to a final state of the finite state machine, the one or more music states including the final state.

3. The computer-implemented method of claim 1, further comprising:

validating, by the computing device, at least one of the identified plurality of note onsets based on a signal spectral energy of one or more of the set of frames.

4. The computer-implemented method of claim 1, further comprising validating, by the computing device, at least one of the identified plurality of note onsets, wherein validating the at least one of the identified plurality of note onsets comprises:

determining a quantity of the set of frames between a first frame of a particular state of the one or more music states and a frame in which a particular note onset is detected;

determining that the quantity of the set of frames between the first frame and the frame of the particular note onset satisfies a defined threshold; and responsive to determining that the quantity of frames satisfies the defined threshold, setting the one or more music states to an initial state, the initial state indicating that music has not been detected in the audio signal.

5. The computer-implemented method of claim 1, wherein validating the one or more tempos based on the tempo validation condition comprises:

computing a quantity of the identified plurality of note onsets during a period of a valid tempo of the one or more tempos;

determining that the quantity of the identified plurality of note onsets satisfies a defined threshold; and responsive to determining that the quantity of the identified plurality of note onsets satisfies the defined threshold, setting the one or more music states to an initial state, the initial state indicating that music has not been detected in the audio signal.

6. The computer-implemented method of claim 1, wherein the tempo validation condition comprises a tempo swing condition; and validating the one or more tempos based on the tempo swing condition comprises:

determining a tempo swing condition threshold based on an initial tempo of the one or more tempos and a defined multiplier;

determining a maximum tempo of the one or more tempos;

determining a minimum tempo of the one or more tempos;

determining a difference between the maximum tempo and the minimum tempo;

determining that the difference satisfies the tempo swing condition threshold; and responsive to determining that the difference satisfies the tempo swing condition threshold, setting the one or more music states to an initial state, the initial state indicating that music has not been detected in the audio signal.

7. The computer-implemented method of claim 1, further comprising:

determining that a plurality of the one or more tempos satisfy a tempo swing condition, the tempo swing condition indicating whether a range of the plurality of the one or more tempos satisfy a determined tempo swing condition threshold; and transitioning a finite state machine from a first of the one or more music states to a second of the one or more music states based on the determination that the plurality of the one or more tempos satisfy the tempo swing condition.

8. The computer-implemented method of claim 1, wherein validating the one or more tempos based on the tempo validation condition comprises:

determining that a second tempo differs from a first tempo by a threshold amount; and responsive to determining that the second tempo differs from the first tempo by greater than the threshold amount:

searching for an additional note onset, determining a tempo for the additional note onset, and determining whether the tempo for the additional note onset satisfies a tempo swing condition, the tempo swing condition indicating whether a range of the first tempo and the second tempo satisfy a determined tempo swing condition threshold.

9. The computer-implemented method of claim 1, wherein determining the one or more music states comprises:

detecting that a state duration of a particular music state of the one or more music states has elapsed;

transitioning a finite state machine from the particular music state to a legato tempo detection state;

detecting a note onset while in the legato tempo detection state;

computing a potential legato tempo based on the detected note onset; and validating the potential legato tempo based on a multiple of an initial tempo of the one or more tempos.

10. The computer-implemented method of claim 1, wherein determining the one or more music states comprises:

computing an average quantity of the set of frames between note onsets in the identified plurality of note onsets;

determining whether the average quantity of the set of frames between the note onsets satisfies a threshold length; and responsive to determining that the average quantity does not satisfy the threshold length, setting the one or more music states to an initial state, the initial state indicating that music has not been detected in the audio signal.

11. The computer-implemented method of claim 1, wherein determining the one or more music states comprises:

determining whether a total onset score satisfies a first threshold, an onset score of the total onset score representing a signal energy of a note onset of the plurality of note onsets;

determining whether a total music factor score satisfies a second threshold, a music factor score representing a high-frequency component of the note onset of the plurality of note onsets;

transitioning a finite state machine to a final state based on the total onset score satisfying the first threshold and the total music factor score satisfying the second threshold, the one or more music states including the final state; and declaring that the audio signal includes music based on the final state.

12. The computer-implemented method of claim 1, wherein determining the set of frames of the audio signal using the audio data comprises performing a Fast Fourier Transform using a windowing function.

13. A computer system comprising:

at least one processor; and a non-transitory computer memory storing instructions that, when executed by the at least one processor, cause the computer system to perform operations comprising:

receiving audio data describing an audio signal;

determining a set of frames of the audio signal using the audio data;

identifying a plurality of note onsets in the set of frames based on spectral energy of the audio signal in the set of frames;

computing one or more tempos based on the identified plurality of note onsets;

validating the one or more tempos based on a tempo validation condition; and determining one or more music states of the audio signal based on the validated one or more tempos comprising:

detecting that a state duration of a particular music state of the one or more music states has elapsed;

transitioning a finite state machine from the particular music state to a legato tempo detection state;

detecting a note onset while in the legato tempo detection state;

computing a potential legato tempo based on the detected note onset; and validating the potential legato tempo based on a multiple of an initial tempo of the one or more tempos.

14. The computer system of claim 13, wherein the operations further comprise:

modifying audio enhancement of the audio signal based on the one or more music states.

15. The computer system of claim 13, wherein the operations further comprise:

determining that a plurality of the one or more tempos satisfy a tempo swing condition, the tempo swing condition indicating whether a range of the plurality of the one or more tempos satisfy a determined tempo swing condition threshold; and transitioning a finite state machine from a first of the one or more music states to a second of the one or more music states based on the determination that the plurality of the one or more tempos satisfy the tempo swing condition.

16. The computer system of claim 13, wherein determining the set of frames of the audio signal using the audio data comprises performing a Fast Fourier Transform using a windowing function.

17. A computer system, comprising:

at least one processor;

a computer memory;

a Fast Fourier Transform module receiving audio data describing an audio signal, and determining a set of frames of the audio signal using the audio data;

a smart music detection module communicatively coupled with the Fast Fourier Transform module to receive frequency domain data describing the set of frames of the audio signal from the Fast Fourier Transform module, the smart music detection module performing operations comprising:

receiving audio data describing an audio signal, determining a set of frames of the audio signal using the audio data, identifying a plurality of note onsets in the set of frames based on spectral energy of the audio signal in the set of frames, computing one or more tempos based on the identified plurality of note onsets, validating the one or more tempos based on a tempo validation condition, and determining one or more music states of the audio signal based on the validated one or more tempos; and a smart noise cancelation module modifying audio enhancement of the audio signal using the one or more music states of the audio signal determined by the smart music detection module, the smart noise cancelation module communicatively coupled with the smart music detection module to receive the one or more determined music states of the audio signal from the smart music detection module.

18. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition;

determining, by the computing device, one or more music states of the audio signal based on the validated one or more tempos;

determining, by the computing device, one or more states of a finite state machine based on the validated one or more tempos; and declaring, by the computing device, that the audio signal includes music based on a transition of the one or more states to a final state of the finite state machine, the one or more music states including the final state.

19. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

validating, by the computing device, at least one of the identified plurality of note onsets, wherein validating the at least one of the identified plurality of note onsets comprises:

determining a quantity of the set of frames between a first frame of a particular state of one or more music states and a frame in which a particular note onset is detected;

determining that the quantity of the set of frames between the first frame and the frame of the particular note onset satisfies a defined threshold; and responsive to determining that the quantity of frames satisfies the defined threshold, setting the one or more music states to an initial state, the initial state indicating that music has not been detected in the audio signal;

computing, by the computing device, one or more tempos based on the identified plurality of note onsets;

validating, by the computing device, the one or more tempos based on a tempo validation condition; and determining, by the computing device, the one or more music states of the audio signal based on the validated one or more tempos.

20. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition comprising:

computing a quantity of the identified plurality of note onsets during a period of a valid tempo of the one or more tempos;

determining that the quantity of the identified plurality of note onsets satisfies a defined threshold; and responsive to determining that the quantity of the identified plurality of note onsets satisfies the defined threshold, setting one or more music states to an initial state, the initial state indicating that music has not been detected in the audio signal; and determining, by the computing device, the one or more music states of the audio signal based on the validated one or more tempos.

21. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition, wherein the tempo validation condition comprises a tempo swing condition and validating the one or more tempos based on the tempo swing condition comprises:

determining a tempo swing condition threshold based on an initial tempo of the one or more tempos and a defined multiplier;

determining a maximum tempo of the one or more tempos;

determining a minimum tempo of the one or more tempos;

determining a difference between the maximum tempo and the minimum tempo;

determining that the difference satisfies the tempo swing condition threshold; and responsive to determining that the difference satisfies the tempo swing condition threshold, setting one or more music states to an initial state, the initial state indicating that music has not been detected in the audio signal; and determining, by the computing device, the one or more music states of the audio signal based on the validated one or more tempos.

22. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition comprising determining that a plurality of the one or more tempos satisfy a tempo swing condition, the tempo swing condition indicating whether a range of the plurality of the one or more tempos satisfy a determined tempo swing condition threshold; and determining, by the computing device, one or more music states of the audio signal based on the validated one or more tempos comprising transitioning a finite state machine from a first of the one or more music states to a second of the one or more music states based on the determination that the plurality of the one or more tempos satisfy the tempo swing condition.

23. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition comprising:

determining that a second tempo differs from a first tempo by a threshold amount; and responsive to determining that the second tempo differs from the first tempo by greater than the threshold amount:

searching for an additional note onset, determining a tempo for the additional note onset, and determining whether the tempo for the additional note onset satisfies a tempo swing condition, the tempo swing condition indicating whether a range of the first tempo and the second tempo satisfy a determined tempo swing condition threshold; and determining, by the computing device, one or more music states of the audio signal based on the validated one or more tempos.

24. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition; and determining, by the computing device, one or more music states of the audio signal based on the validated one or more tempos comprising:

computing an average quantity of the set of frames between note onsets in the identified plurality of note onsets;

determining whether the average quantity of the set of frames between the note onsets satisfies a threshold length; and responsive to determining that the average quantity does not satisfy the threshold length, setting the one or more music states to an initial state, the initial state indicating that music has not been detected in the audio signal.

25. A computer-implemented method, comprising:

receiving, by a computing device, audio data describing an audio signal;

determining, by the computing device, a set of frames of the audio signal using the audio data;

identifying, by the computing device, a plurality of note onsets in the set of frames based on spectral energy of the audio signal in the set of frames;

computing, by the computing device, one or more tempos based on the identified plurality of note onsets;

validating, by the computing device, the one or more tempos based on a tempo validation condition; and determining, by the computing device, one or more music states of the audio signal based on the validated one or more tempos comprising:

determining whether a total onset score satisfies a first threshold, an onset score of the total onset score representing a signal energy of a note onset of the plurality of note onsets;

determining whether a total music factor score satisfies a second threshold, a music factor score representing a high-frequency component of the note onset of the plurality of note onsets;

transitioning a finite state machine to a final state based on the total onset score satisfying the first threshold and the total music factor score satisfying the second threshold, the one or more music states including the final state; and declaring that the audio signal includes music based on the final state.

* * * * *